US009214120B2

(12) United States Patent
Nakanishi et al.

(10) Patent No.: US 9,214,120 B2
(45) Date of Patent: Dec. 15, 2015

(54) DISPLAY DEVICE

(71) Applicant: PANASONIC LIQUID CRYSTAL DISPLAY CO., LTD., Hyogo (JP)

(72) Inventors: Hideyuki Nakanishi, Osaka (JP); Seiji Kawaguchi, Osaka (JP)

(73) Assignee: PANASONIC LIQUID CRYSTAL DISPLAY CO., LTD., Hyogo (JP)

( * ) Notice: Subject to any disclaimer, the term of this patent is extended or adjusted under 35 U.S.C. 154(b) by 121 days.

(21) Appl. No.: 14/024,597

(22) Filed: Sep. 11, 2013

(65) Prior Publication Data

US 2014/0071105 A1 Mar. 13, 2014

(30) Foreign Application Priority Data

Sep. 12, 2012 (JP) ..... 2012-200515
Sep. 12, 2012 (JP) ..... 2012-200516

(51) Int. Cl.
*G09G 3/36* (2006.01)

(52) U.S. Cl.
CPC ..... *G09G 3/3614* (2013.01)

(58) Field of Classification Search
CPC ..... G09G 3/36; G09G 3/3614; G09G 5/00; G09G 5/10; G06F 3/038; A01B 12/006
USPC ..... 345/89, 96, 98, 204, 211, 212, 690
See application file for complete search history.

(56) References Cited

U.S. PATENT DOCUMENTS

2010/0118013 A1* 5/2010 Kitayama et al. ..... 345/211
2012/0287170 A1* 11/2012 Cheng et al. ..... 345/690
2012/0320009 A1* 12/2012 Liu ..... 345/204
2013/0016085 A1* 1/2013 Wu ..... 345/212

FOREIGN PATENT DOCUMENTS

JP 2005-215591 A 8/2005

* cited by examiner

*Primary Examiner* — Lun-Yi Lao
*Assistant Examiner* — Johny Lau
(74) *Attorney, Agent, or Firm* — McDermott Will & Emery LLP

(57) ABSTRACT

A controller in an intermediate inversion drive mode causes a source driver to alternate polarities of voltages applied to pixel electrodes connected to one of source signal lines per plural gate signal lines, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame. When the source driver, in the intermediate inversion drive mode, applies the voltages sequentially to the pixel electrodes connected to one of the source signal lines, the controller sets a longer voltage application period for the inverted electrode than for the equivalent electrode.

20 Claims, 21 Drawing Sheets

FIG. 12B

| | S1 | S2 | S3 | S4 | S5 | S6 | S7 | S8 |
|---|---|---|---|---|---|---|---|---|
| G1 | − | + | − | + | − | + | − | + |
| G2 | − | + | − | + | − | + | − | + |
| G3 | − | + | − | + | − | + | − | + |
| G4 | − | + | − | + | − | + | − | + |
| G5 | − | + | − | + | − | + | − | + |
| G6 | − | + | − | + | − | + | − | + |
| G7 | − | + | − | + | − | + | − | + |
| G8 | − | + | − | + | − | + | − | + |

FIG. 12A

| | S1 | S2 | S3 | S4 | S5 | S6 | S7 | S8 |
|---|---|---|---|---|---|---|---|---|
| G1 | + | − | + | − | + | − | + | − |
| G2 | + | − | + | − | + | − | + | − |
| G3 | + | − | + | − | + | − | + | − |
| G4 | + | − | + | − | + | − | + | − |
| G5 | + | − | + | − | + | − | + | − |
| G6 | + | − | + | − | + | − | + | − |
| G7 | + | − | + | − | + | − | + | − |
| G8 | + | − | + | − | + | − | + | − |

FIG. 13B

| | S1 | S2 | S3 | S4 | S5 | S6 | S7 | S8 |
|---|---|---|---|---|---|---|---|---|
| G1 | − | + | − | + | − | + | − | + |
| G2 | − | + | − | + | − | + | − | + |
| G3 | − | + | − | + | − | + | − | + |
| G4 | − | + | − | + | − | + | − | + |
| G5 | + | − | + | − | + | − | + | − |
| G6 | + | − | + | − | + | − | + | − |
| G7 | + | − | + | − | + | − | + | − |
| G8 | + | − | + | − | + | − | + | − |

FIG. 13A

| | S1 | S2 | S3 | S4 | S5 | S6 | S7 | S8 |
|---|---|---|---|---|---|---|---|---|
| G1 | + | − | + | − | + | − | + | − |
| G2 | + | − | + | − | + | − | + | − |
| G3 | + | − | + | − | + | − | + | − |
| G4 | + | − | + | − | + | − | + | − |
| G5 | − | + | − | + | − | + | − | + |
| G6 | − | + | − | + | − | + | − | + |
| G7 | − | + | − | + | − | + | − | + |
| G8 | − | + | − | + | − | + | − | + |

FIG. 14B

| | S1 | S2 | S3 | S4 | S5 | S6 | S7 | S8 |
|---|---|---|---|---|---|---|---|---|
| G1 | − | + | − | + | − | + | − | + |
| G2 | − | + | − | + | − | + | − | + |
| G3 | + | − | + | − | + | − | + | − |
| G4 | + | − | + | − | + | − | + | − |
| G5 | − | + | − | + | − | + | − | + |
| G6 | − | + | − | + | − | + | − | + |
| G7 | + | − | + | − | + | − | + | − |
| G8 | + | − | + | − | + | − | + | − |

FIG. 14A

| | S1 | S2 | S3 | S4 | S5 | S6 | S7 | S8 |
|---|---|---|---|---|---|---|---|---|
| G1 | + | − | + | − | + | − | + | − |
| G2 | + | − | + | − | + | − | + | − |
| G3 | − | + | − | + | − | + | − | + |
| G4 | − | + | − | + | − | + | − | + |
| G5 | + | − | + | − | + | − | + | − |
| G6 | + | − | + | − | + | − | + | − |
| G7 | − | + | − | + | − | + | − | + |
| G8 | − | + | − | + | − | + | − | + |

FIG. 15B

| | S1 | S2 | S3 | S4 | S5 | S6 | S7 | S8 |
|---|---|---|---|---|---|---|---|---|
| G1 | − | + | − | + | − | + | − | + |
| G2 | + | − | + | − | + | − | + | − |
| G3 | − | + | − | + | − | + | − | + |
| G4 | + | − | + | − | + | − | + | − |
| G5 | − | + | − | + | − | + | − | + |
| G6 | + | − | + | − | + | − | + | − |
| G7 | − | + | − | + | − | + | − | + |
| G8 | + | − | + | − | + | − | + | − |

FIG. 15A

| | S1 | S2 | S3 | S4 | S5 | S6 | S7 | S8 |
|---|---|---|---|---|---|---|---|---|
| G1 | + | − | + | − | + | − | + | − |
| G2 | − | + | − | + | − | + | − | + |
| G3 | + | − | + | − | + | − | + | − |
| G4 | − | + | − | + | − | + | − | + |
| G5 | + | − | + | − | + | − | + | − |
| G6 | − | + | − | + | − | + | − | + |
| G7 | + | − | + | − | + | − | + | − |
| G8 | − | + | − | + | − | + | − | + |

FIG. 17

| | S1 | S2 | S3 | S4 | S5 | S6 | S7 | S8 |
|---|---|---|---|---|---|---|---|---|
| G1 | + | − | + | − | + | − | + | − |
| G2 | + | − | + | − | + | − | + | − |
| G3 | + | − | + | − | + | − | + | − |
| G4 | + | − | + | − | + | − | + | − |
| G5 | + | − | + | − | + | − | + | − |
| G6 | + | − | + | − | + | − | + | − |
| G7 | + | − | + | − | + | − | + | − |
| G8 | + | − | + | − | + | − | + | − |

FIG. 18

| | S1 | S2 | S3 | S4 | S5 | S6 | S7 | S8 |
|---|---|---|---|---|---|---|---|---|
| G1 | − | + | − | + | − | + | − | + |
| G2 | − | + | − | + | − | + | − | + |
| G3 | − | + | − | + | − | + | − | + |
| G4 | − | + | − | + | − | + | − | + |
| G5 | + | − | + | − | + | − | + | − |
| G6 | + | − | + | − | + | − | + | − |
| G7 | + | − | + | − | + | − | + | − |
| G8 | + | − | + | − | + | − | + | − |

FIG. 19

| | S1 | S2 | S3 | S4 | S5 | S6 | S7 | S8 |
|---|---|---|---|---|---|---|---|---|
| G1 | + | − | + | − | + | − | + | − |
| G2 | + | − | + | − | + | − | + | − |
| G3 | − | + | − | + | − | + | − | + |
| G4 | − | + | − | + | − | + | − | + |
| G5 | + | − | + | − | + | − | + | − |
| G6 | + | − | + | − | + | − | + | − |
| G7 | − | + | − | + | − | + | − | + |
| G8 | − | + | − | + | − | + | − | + |

FIG. 20

| | S1 | S2 | S3 | S4 | S5 | S6 | S7 | S8 |
|---|---|---|---|---|---|---|---|---|
| G1 | − | + | − | + | − | + | − | + |
| G2 | + | − | + | − | + | − | + | − |
| G3 | − | + | − | + | − | + | − | + |
| G4 | + | − | + | − | + | − | + | − |
| G5 | − | + | − | + | − | + | − | + |
| G6 | + | − | + | − | + | − | + | − |
| G7 | − | + | − | + | − | + | − | + |
| G8 | + | − | + | − | + | − | + | − |

DISPLAY DEVICE

CROSS-REFERENCE TO RELATED APPLICATIONS

This application claims the benefit of priority to Japanese Patent Applications No. 2012-200515 and No. 2012-200516 filed on Sep. 12, 2012, the entire content of which is hereby incorporated herein by reference.

TECHNICAL FIELD

The present disclosure relates to a liquid crystal display device for displaying images on a liquid crystal display portion.

BACKGROUND

A liquid crystal display device is used as the display device of high resolution color monitors of computers and other information equipments, or television receivers. A liquid crystal display device fundamentally includes a liquid crystal display portion in which liquid crystals are sandwiched between two substrates of which at least one is made of transparent glass or the like. In addition, a liquid crystal display device includes a driver for selectively applying voltages to pixel electrodes formed on the substrate of the liquid crystal display portion. Pixels of the respective pixel electrodes are controlled based on the voltage application by the driver.

A liquid crystal display portion generally includes gate signal lines, source signal lines and pixel electrodes. The gate signal lines, for instance, respectively extend in the horizontal direction (main scanning direction), and are aligned in the vertical direction (sub scanning direction). The source signal lines, for instance, respectively extend in the vertical direction (sub scanning direction), and are aligned in the horizontal direction (main scanning direction). Thin film transistors (TFT) and pixel electrodes are disposed in a matrix at the intersection points of the gate signal lines and the source signal lines. The driver applies voltages to the gate signal lines for turning the TFT ON and OFF. Moreover, the driver applies voltages based on the input image signal to the pixel electrodes via the source signal lines, to thereby change transmittance of the liquid crystals provided corresponding to the pixel electrodes to a value according to the applied voltage. Here, the driver retains the input image signal for one horizontal period, and outputs the input image signal to the source signal lines of the liquid crystal display portion.

In general, when DC drive voltages are applied to the pixel electrodes for driving the liquid crystals, the liquid crystals become deteriorated and the life thereof is shortened, and hence, an AC voltage drive of inverting the polarity of the voltage applied to the pixel electrodes for each frame is performed in a liquid crystal display portion. As the drive modes of the liquid crystal display portion for performing the AC voltage drive, a column inversion drive mode and a dot inversion drive mode are known. The column inversion drive mode is a drive mode of applying voltages of the same polarity to the pixel electrodes connected to the same source signal line, inverting the polarity of the voltage applied to the pixel electrodes connected to mutually adjacent source signal lines in the respective frames, and inverting the polarity of the voltage applied to the respective pixel electrodes for each frame. The dot inversion drive mode is a drive mode of applying voltages of a reverse polarity to mutually adjacent pixel electrodes in the respective frames, and inverting the polarity of the voltage applied to the respective pixel electrodes for each frame.

Here, the column inversion drive mode and the dot inversion drive mode are compared. In the column inversion drive mode, polarities of voltages applied to the pixel electrodes connected to the source signal line are the same throughout one frame period. Thus, the column inversion drive mode is a drive mode that is advantageous in the data writing (voltage application) to the pixel electrodes, and is suitable when a long data writing time may not be secured. Meanwhile, the column inversion drive mode is inferior in terms of performance against crosstalk and flicker. Contrarily, although the dot inversion drive mode causes superior performance against crosstalk and flicker, it takes a relatively long period of time to write data to the pixel electrodes.

Thus, the device described in JP-A-2005-215591 switches the drive mode of the liquid crystal display portion to be the column inversion drive mode when the frame rate of the input image signal is high, and to be the dot inversion drive mode when the frame rate of the input image signal is low.

Switching the drive mode of the liquid crystal display portion directly between the dot inversion drive mode and the column inversion drive mode is likely to cause a drastic load change and discontinuous image display on the liquid crystal display portion during the switching of the drive mode, which results in a boundary between images. In the foregoing case, image display quality may deteriorate. However, the device described in foregoing JP-A-2005-215591 fails to give any consideration to this point.

SUMMARY

An object of the present disclosure is to provide a liquid crystal display device capable of inhibiting excessive deterioration in the image display quality during the switching of the drive mode of the liquid crystal display portion.

In one general aspect, the instant application describes a liquid crystal display portion including source signal lines, gate signal lines and pixel electrodes connected to the source signal lines and the gate signal lines, the liquid crystal display portion configured to display an image in correspondence to an input image signal for each frame; a source driver configured to apply voltages in correspondence to the input image signal to the pixel electrodes through the source signal lines; a gate driver configured to output gate signals to the gate signal lines sequentially; and a controller configured to control the source driver and the gate driver to cause the source driver to apply a voltage to each of the pixel electrodes, for each gate signal line, in response to an output of each of the gate signals from the gate driver, the pixel electrodes connected to one of the source signal lines, wherein the controller switches a drive mode of voltage application to the pixel electrodes between a first drive mode and a second drive mode, the controller causing an intermediate inversion drive mode to intervene between the first drive mode and the second drive mode, the controller in the intermediate inversion drive mode causes the source driver to alternate polarities of the voltages applied to the pixel electrodes connected to one of the source signal lines per plural gate signal lines, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame, an inverted electrode is a pixel electrode which is subjected to a different voltage in polarity from a voltage that another pixel electrode receives immediately before the inverted electrode, an equivalent electrode is a pixel electrode which is subjected to a common voltage in polarity with a voltage that another pixel electrode receives immediately before the equivalent electrode, and when the source driver, in the intermediate inversion drive mode, applies the voltages sequentially to the pixel electrodes connected to one of the source signal lines, the controller sets a longer voltage application period for the inverted electrode than for the equivalent electrode.

According to one aspect of the present disclosure, the drive mode of voltage application to the pixel electrodes is switched between the first drive mode and the second drive mode via the intermediate inversion drive mode. Hence, the drive mode may be smoothly switched in comparison to cases of directly switching from the first drive mode to the second drive mode or directly switching from the second drive mode to the first drive mode. The voltage application period to the pixel electrode which is subjected to a different voltage in polarity from a voltage that another pixel electrode receives immediately before the pixel electrode is set to be longer than a voltage application period to the pixel electrode which is subjected to a common voltage in polarity with a voltage that another pixel electrode receives immediately before the pixel electrode. Hence, it is possible to prevent the actually applied voltage from becoming insufficient, and inhibit the excessive deterioration in the display quality of the image.

In another general aspect, the instant application describes a liquid crystal display that may include a liquid crystal display portion including source signal lines, gate signal lines and pixel electrodes connected to the source signal lines and the gate signal lines, the liquid crystal display portion configured to display an image in correspondence to an input image signal for each frame; a driver configured to apply voltages to the pixel electrodes in correspondence to the input image signal; and a controller configured to control the driver to switch a drive mode of voltage application to the pixel electrodes between a first drive mode and a second drive mode, the controller causing an intermediate inversion drive mode to intervene between the first drive mode and the second drive mode, wherein the controller in the intermediate inversion drive mode causes the driver to alternate polarities of the voltages applied to the pixel electrodes connected to one of the source signal lines per plural gate signal lines, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame.

According to another aspect of the present disclosure, the drive mode of voltage application to the pixel electrodes is switched between the first drive mode and the second drive mode via the intermediate inversion drive mode. Hence, the drive mode may be smoothly switched in comparison to cases of directly switching from the first drive mode to the second drive mode or directly switching from the second drive mode to the first drive mode. As a result, it is possible to inhibit the deterioration in the image quality, due to the generation of a boundary between images as a result of discontinuous image display on the liquid crystal display portion, during the switching of the drive mode.

BRIEF DESCRIPTION OF THE DRAWINGS

FIGS. 12A and 12B are diagrams schematically showing polarities of applied voltages of respective pixel electrodes in the column inversion drive mode;

FIGS. 13A and 13B are diagrams schematically showing polarities of applied voltages of respective pixel electrodes in the intermediate inversion drive mode;

FIGS. 14A and 14B are diagrams schematically showing polarities of applied voltages of respective pixel electrodes in the intermediate inversion drive mode;

FIGS. 15A and 15B are diagrams schematically showing polarities of applied voltages of respective pixel electrodes in the dot inversion drive mode;

FIG. 17 is a diagram schematically showing polarities of applied voltages of respective pixel electrodes in the column inversion drive mode;

FIG. 18 is a diagram schematically showing polarities of applied voltages of respective pixel electrodes in the intermediate inversion drive mode;

FIG. 19 is a diagram schematically showing polarities of applied voltages of respective pixel electrodes in the intermediate inversion drive mode;

FIG. 20 is a diagram schematically showing polarities of applied voltages of respective pixel electrodes in the dot inversion drive mode;

FIGS. 22A and 22B are diagrams showing applied voltages to the source signal line when a white image is to be displayed on pixels of pixel electrodes connected to the source signal line, wherein FIG. 22A shows a voltage level in this embodiment and FIG. 22B shows, as a comparative example, a voltage level corresponding to the signal level of the input image signal;

FIGS. 24A and 24B are diagrams showing applied voltages to the source signal line when a white image is to be displayed on pixels of pixel electrodes connected to the source signal line in a case where the drive mode is switched from the column inversion drive mode to the intermediate inversion drive mode, wherein FIG. 24A shows a voltage level in this embodiment and FIG. 24B shows, as a comparative example, a voltage level corresponding to the signal level of the input image signal; and FIGS. 25A and 25B are diagrams showing applied voltages to the source signal line when a white image is to be displayed on pixels of pixel electrodes connected to the source signal line S1 in a case where the drive mode is switched from the intermediate inversion drive mode to the dot inversion drive mode, wherein FIG. 25A shows a voltage level in this embodiment and FIG. 25B shows, as a comparative example, a voltage level corresponding to the signal level of the input image signal.

DETAILED DESCRIPTION (First Embodiment)

Figure 1:
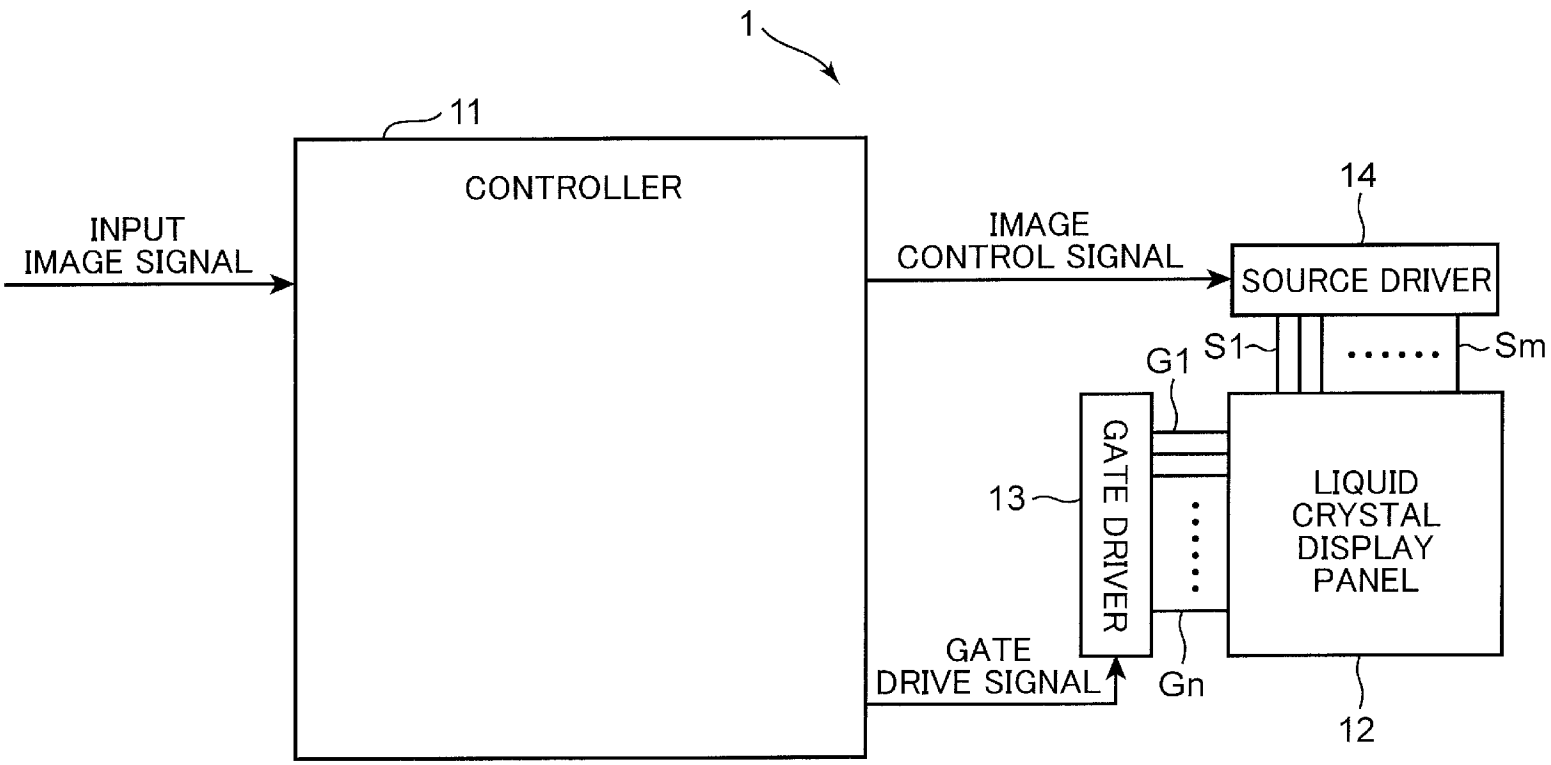
FIG. 1 is a block diagram showing a configuration of a liquid crystal display device of the first embodiment of the present application.
Figure 2:
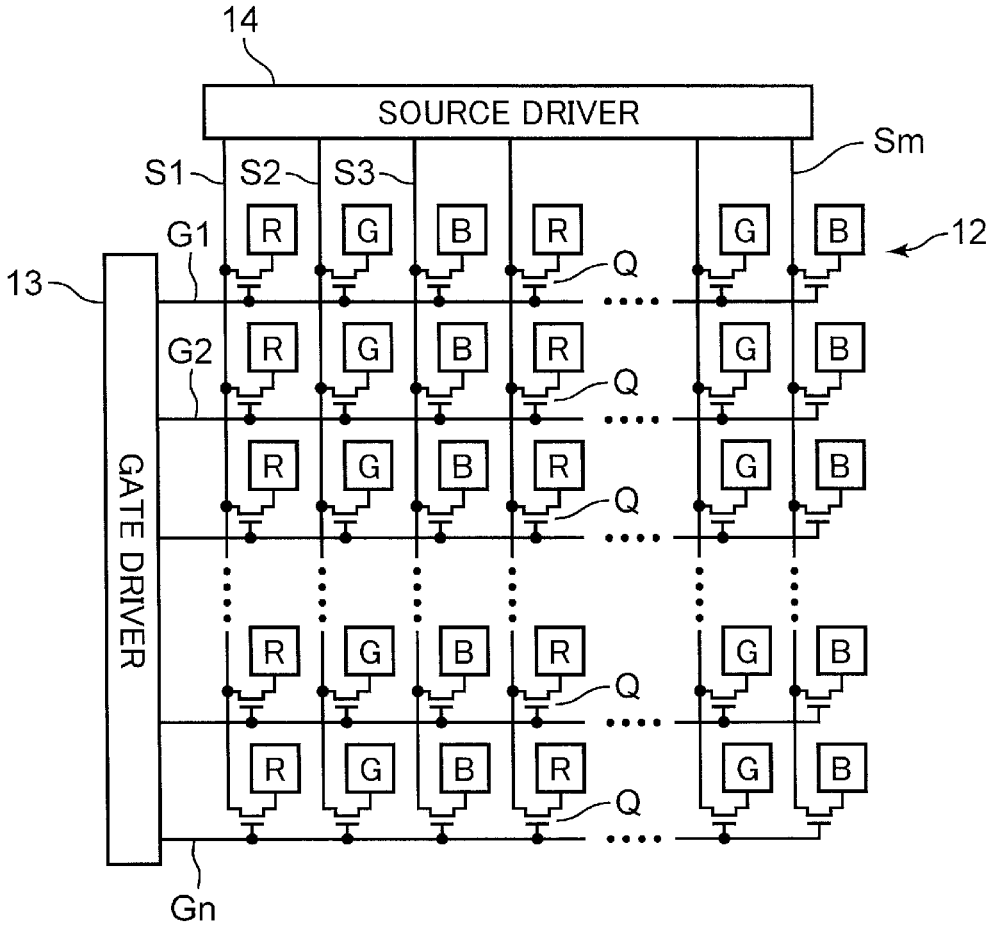
FIG. 2 is a circuit diagram showing connection status of signal lines of the liquid crystal display panel illustrated in FIG. 1.

FIG. 1 is a block diagram showing a configuration of a liquid crystal display device of the first embodiment of the present application. FIG. 2 is a circuit diagram showing connection status of the signal lines of the liquid crystal display panel illustrated in FIG. 1. As shown in FIG. 1, the liquid crystal display device 1 includes a controller 11, a liquid crystal display panel 12, a gate driver 13, and a source driver 14.

The liquid crystal display panel 12 includes, as shown in FIG. 2, source signal lines S1, S2, . . . , Sm, gate signal lines G1, G2, . . . , Gn, thin film transistors Q and pixel electrodes R, G, B (that is, red pixel electrodes R, green pixel electrodes G and blue pixel electrodes B). The source signal lines S1, S2, . . . , Sm respectively extend in the vertical direction (sub scanning direction), and are aligned in the horizontal direction (main scanning direction). The gate signal lines G1, G2, . . . , Gn extend in the horizontal direction (main scanning direction), and are aligned in the vertical direction (sub scanning direction). The thin film transistors Q and the pixel electrodes R, G, B are disposed in a matrix at the intersection points of the source signal lines S1, S2, . . . , Sm and the gate signal lines G1, G2, . . . , Gn.

The controller 11 controls the gate driver 13 and the source driver 14, to thereby apply a voltage corresponding to an input image signal once, for each frame, to the pixel electrodes, which are disposed in a matrix, of the liquid crystal display panel 12. In other words, the controller 11 once writes image data, for each frame, to the pixels of the pixel electrodes, which are disposed in a matrix, of the liquid crystal display panel 12. The controller 11 outputs a gate drive signal to the gate driver 13. The gate driver 13 applies a scan voltage based on the gate drive signal, to sequentially select the gate signal lines G1, G2, . . . , Gn from the top to the bottom, to turn on the thin film transistor Q of the corresponding gate signal line G1, G2, . . . , Gn.

The controller 11 outputs an image control signal to the source driver 14 to control the source driver 14. The source driver 14 applies a voltage corresponding to image data, via the source signal lines S1, S2, . . . , Sm, to the pixel electrodes R, G, B corresponding to the gate signal lines G1, G2, . . . , Gn that have been selected by the gate driver 13 (that is, in which the thin film transistor Q has been turned ON). Consequently, a voltage corresponding to the image data is applied to the liquid crystal layer of the pixel electrodes R, G, B, and the transmittance of the liquid crystal layer of the pixel electrodes R, G, B is thereby controlled.

As a result of completion of the selection of the gate signal lines G1, G2, . . . , Gn from the top to the bottom by the gate driver 13, the image data is written once into all pixels based on the input image signal. An image of one frame is generated based on the writing of the image data into all pixels. The liquid crystal display panel 12 is a hold-type display portion which holds the written image data for one frame period up to the writing of the subsequent image data.

As a result of generation of an image of one frame being repeated at a predetermined frame frequency by the controller 11, the image displayed on the liquid crystal display panel 12 may be visually recognized by a viewer. Note that the in plane switching (IPS) system, the vertical alignment (VA) system, or other systems may be adopted as the liquid crystal display panel 12.

Figure 3:
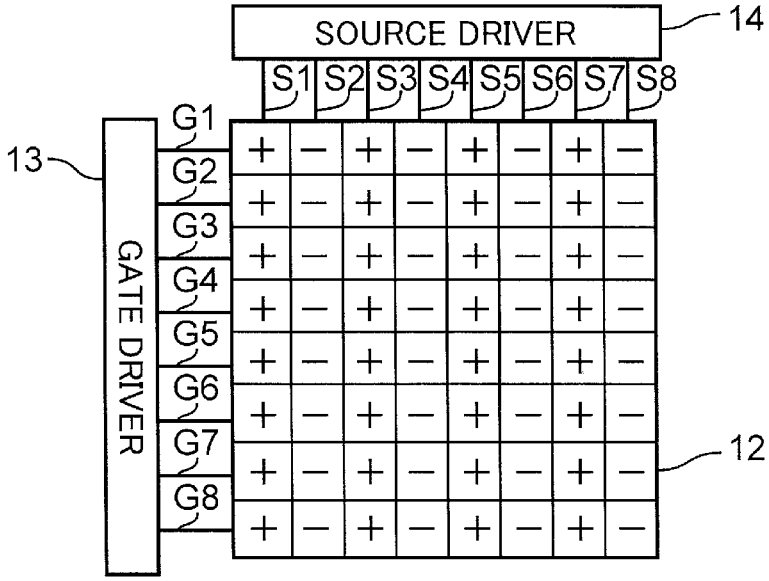
FIG. 3 is a diagram showing polarities of applied voltages of respective pixel electrodes in a certain frame in the liquid crystal display panel, and shows a column inversion drive mode.
Figure 4:
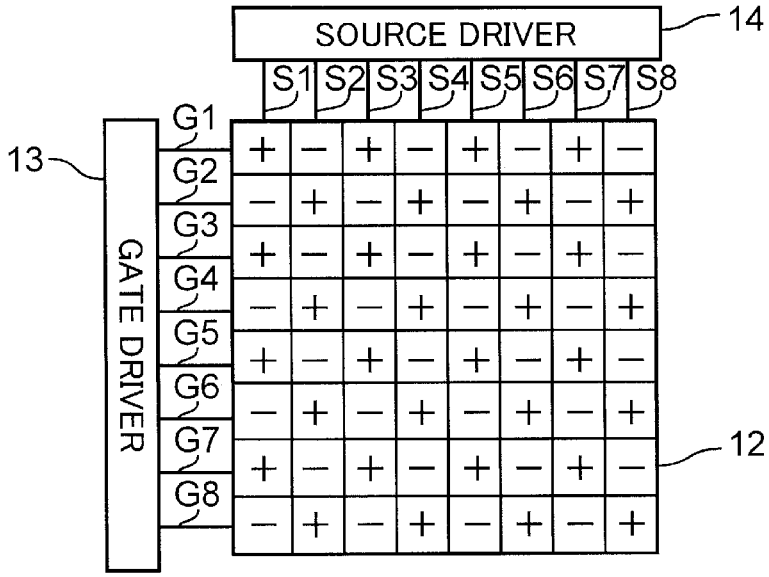
FIG. 4 is a diagram showing polarities of applied voltages of respective pixel electrodes in a certain frame in the liquid crystal display panel, and shows a dot inversion drive mode.
Figure 5:
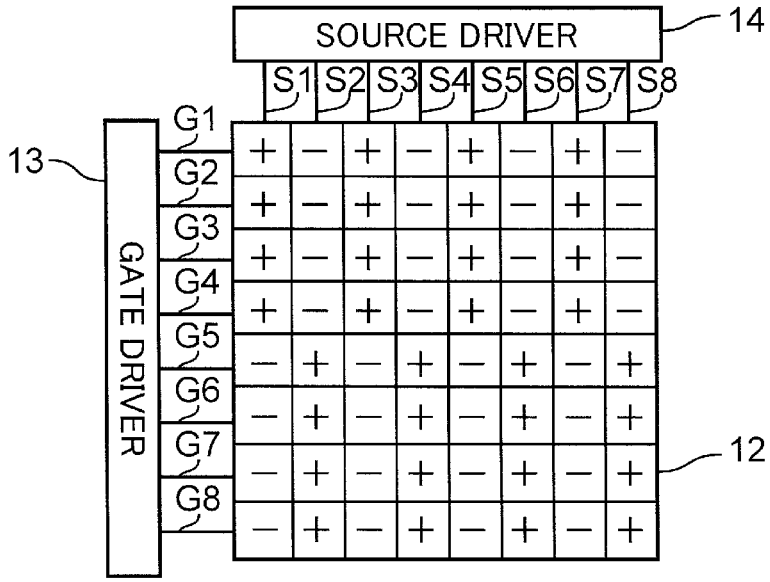
FIG. 5 is a diagram showing polarities of applied voltages of respective pixel electrodes in a certain frame in the liquid crystal display panel, and shows an intermediate inversion drive mode.
Figure 6:
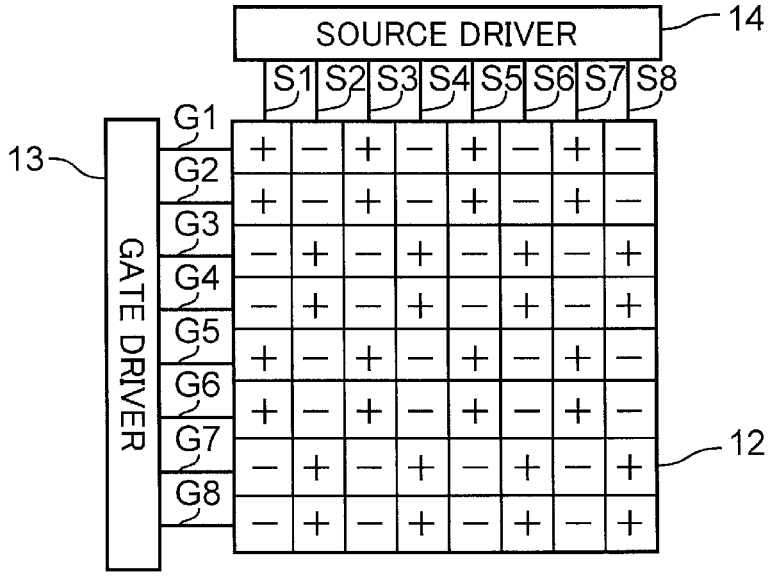
FIG. 6 is a diagram showing polarities of applied voltages of respective pixel electrodes in a certain frame in the liquid crystal display panel, and shows an intermediate inversion drive mode.

FIGS. 3 to 6 are diagrams showing polarities of applied voltages of the respective pixel electrodes in a certain frame in the liquid crystal display panel 12. FIG. 3 shows the column inversion drive mode. FIG. 4 shows the dot inversion drive mode. FIG. 5 and FIG. 6 show the intermediate inversion drive mode. Note that, hereinafter, in order to simplify the description, as shown in FIGS. 3 to 6, the number of source signal lines is m=8, and the number of gate signal lines is n=8.

In general, when DC drive voltages are applied to the pixel electrodes for driving the liquid crystals in a liquid crystal display panel, it is known that the liquid crystals become deteriorated and the life thereof is shortened and, consequently, the display quality may deteriorate. Thus, with the liquid crystal display panel 12 of this embodiment, an AC voltage drive of inverting the polarity of the voltage applied to the pixel electrodes for each frame is performed. In addition, the column inversion drive mode, the dot inversion drive mode, and the intermediate inversion drive mode are adopted as the drive modes for voltage application to the pixel electrodes, in the liquid crystal display panel 12 of this embodiment.

As shown in FIG. 3, the column inversion drive mode is a drive mode of applying a voltage of a same polarity to the pixel electrodes connected to the same source signal line, inverting polarity of a voltage applied to the pixel electrodes connected to mutually adjacent source signal lines in the respective frames, and inverting polarity of a voltage applied to the respective pixel electrodes for each frame. In other words, in the column inversion drive mode, the polar state shown in FIG. 3 and the polar state which is an inversion of the respective polarities of FIG. 3 are alternately repeated for each frame.

As shown in FIG. 4, the dot inversion drive mode is a drive mode of applying a voltage of a reverse polarity to mutually adjacent pixel electrodes in the respective frames, and inverting polarity of a voltage applied to the respective pixel electrodes for each frame. In other words, in the dot inversion drive mode, the polar state shown in FIG. 4 and the polar state which is an inversion of the respective polarities of FIG. 4 are alternately repeated for each frame. Note that, in FIG. 3 for instance, the wording of "polarity of the applied voltage to the pixel electrodes connected to the source signal line S1" is also described as "polarity of the applied voltage to the source signal line S1" for simplification, hereinafter.

In the column inversion drive mode, in a certain frame, as shown in FIG. 3 for instance, when the polarity of the applied voltage to the source signal line S1 is "+", the polarity of the applied voltage to the source signal line S2 is "−", and the polarity of the applied voltage to the source signal line S3 is "+". In the frame that is subsequent to the frame shown in FIG. 3, the polarity of the applied voltage to the source signal line S1 is "−", the polarity of the applied voltage to the source signal line S2 is "+", and the polarity of the applied voltage to the source signal line S3 is "−".

In the frame shown in FIG. 3 for instance, the applied voltage to the source signal line S1 is set to be the same "+" polarity. Accordingly, when a white image is displayed on the entire screen of the liquid crystal display panel 12, a voltage of the same level of the same polarity may be applied even when the selected gate signal lines G1, G2, . . . are changed. Thus, since a charge-discharge may not occur in the source signal lines, supply of current from the source driver 14 to the source signal lines is inhibited. Consequently, the power consumption in the source driver 14 is reduced. Meanwhile, in the dot inversion drive mode, polarities of applied voltages to the mutually adjacent pixel electrodes are inverted in both directions; namely, a direction along the gate signal lines and a direction along the source signal lines, in a certain frame as shown in FIG. 4 for instance.

Accordingly, since the responsiveness to the applied voltage becomes favorable in the column inversion drive mode in comparison to the dot inversion drive mode, image data may be written into the pixels in a short time. Meanwhile, the dot inversion drive mode is superior in terms of performance against crosstalk and flicker in comparison to the column inversion drive mode.

The controller 11 determines the voltage levels to be applied to the respective pixel electrodes based on the signal level of the input image signal. The controller 11 generates an image control signal based on the determined voltage level, and outputs the generated image control signal to the source driver 14. The controller 11 detects, as the feature amount of the input image signal, the frame rate upon displaying images on the liquid crystal display panel 12. The controller 11 switches the drive mode based on the detected frame rate.

Specifically, the controller 11 switches the drive mode to the column inversion drive mode when the frame rate is equal to or higher than a reference value (in this embodiment, for instance, 60 Hz). Whereas, the controller 11 switches the drive mode to the dot inversion drive mode when the frame rate is less than the reference value.

In other words, the controller 11 switches the drive mode from the column inversion drive mode to the dot inversion drive mode when the frame rate of the input image signal is switched, for example, from 60 Hz to 30 Hz. Moreover, the controller 11 switches the drive mode from the dot inversion drive mode to the column inversion drive mode when the frame rate of the input image signal is switched, for example, from 30 Hz to 60 Hz.

Note that, as the feature amount of the input image signal, the controller 11 may also detect the moving amount of the object in the image displayed on the liquid crystal display panel 12 in substitute for, or in addition to, the frame rate. In addition, when the detected moving amount is equal to or greater than a threshold value (in this embodiment, for example, ten pixels between temporally adjacent frames), the controller 11 may switch the drive mode to the column inversion drive mode. Moreover, when the detected moving amount is less than the threshold value, the controller 11 may switch the drive mode to the dot inversion drive mode.

The controller 11 controls the gate driver 13 and the source driver 14 so that, upon switching the drive mode of the voltage application to the pixel electrodes between the column inversion drive mode and the dot inversion drive mode, such switching is performed via the intermediate inversion drive mode. In other words, the controller 11 does not directly switch from the column inversion drive mode to the dot inversion drive mode, or directly switch from the dot inversion drive mode to the column inversion drive mode.

The intermediate inversion drive mode is, as shown in FIG. 5 and FIG. 6, a drive mode of inverting polarity of a voltage applied to the pixel electrodes connected to one source signal line every plural gate signal lines, and inverting polarity of a voltage applied to the pixel electrodes connected to mutually adjacent source signal lines and connected to the same gate signal line. In other words, in the intermediate inversion drive mode, the polar state of the applied voltage is an intermediate polar state between the column inversion drive mode and the dot inversion drive mode.

When the controller 11 switches the drive mode from the column inversion drive mode to the dot inversion drive mode, in the intermediate inversion drive mode, the controller 11 foremost uses the inversion pattern of inverting the polarity of the applied voltage every (n/2) gate signal lines, when there are n-number of gate signal lines as shown in FIG. 2. Subsequently, the controller 11 uses the inversion pattern of inverting the polarity of the applied voltage every ($n/2^2$) gate signal lines. The controller 11 thereafter uses the inversion pattern of inverting the polarity of the applied voltage every ($n/2^3$) gate signal lines.

As described above, the controller 11, in this embodiment, sequentially uses inversion patterns, in which the number of gate signal lines where the polarity is inverted is reduced ½ at a time, in the intermediate inversion drive mode upon switching from the column inversion drive mode to the dot inversion drive mode. In addition, the controller 11 uses the inversion pattern of inverting the polarity of the applied voltage every two gate signal lines at the end of the intermediate inversion drive mode, and thereafter switches the drive mode to the dot inversion drive mode. Moreover, in the intermediate inversion drive mode, the controller 11 uses the same inversion pattern for at least two consecutive frames. Note that, when the controller 11 switches from the dot inversion drive mode to the column inversion drive mode, in the intermediate inversion drive mode, the controller 11 sequentially uses inversion patterns, in which the number of gate signal lines where the polarity is inverted is increased twofold at a time.

In the intermediate inversion drive mode shown in FIG. 5, the polarity of the voltage applied to the pixel electrodes connected to one source signal line is inverted once. To put it differently, in the intermediate inversion drive mode shown in FIG. 5, an inversion pattern of inverting the polarity of the applied voltage every four gate signal lines is used. In the intermediate inversion drive mode shown in FIG. 6, the polarity of the voltage applied to the pixel electrodes connected to one source signal line is inverted three times. To put it differently, in the intermediate inversion drive mode shown in FIG. 6, an inversion pattern of inverting the polarity of the applied voltage every two gate signal lines is used.

When the number of gate signal lines is n=8, upon switching from the column inversion drive mode shown in FIG. 3 to the dot inversion drive mode shown in FIG. 4, the controller 11, in the intermediate inversion drive mode, uses the inversion pattern shown in FIG. 5 for at least two consecutive frames, and thereafter uses the inversion pattern shown in FIG. 6 for at least two consecutive frames. In this embodiment, the column inversion drive mode corresponds to an example of the first drive mode, the dot inversion drive mode corresponds to an example of the second drive mode, the inversion pattern of the intermediate inversion drive mode shown in FIG. 5 corresponds to an example of the first polarity inversion pattern, and the inversion pattern of the intermediate inversion drive mode shown in FIG. 6 corresponds to an example of the second polarity inversion pattern.

Figure 7:
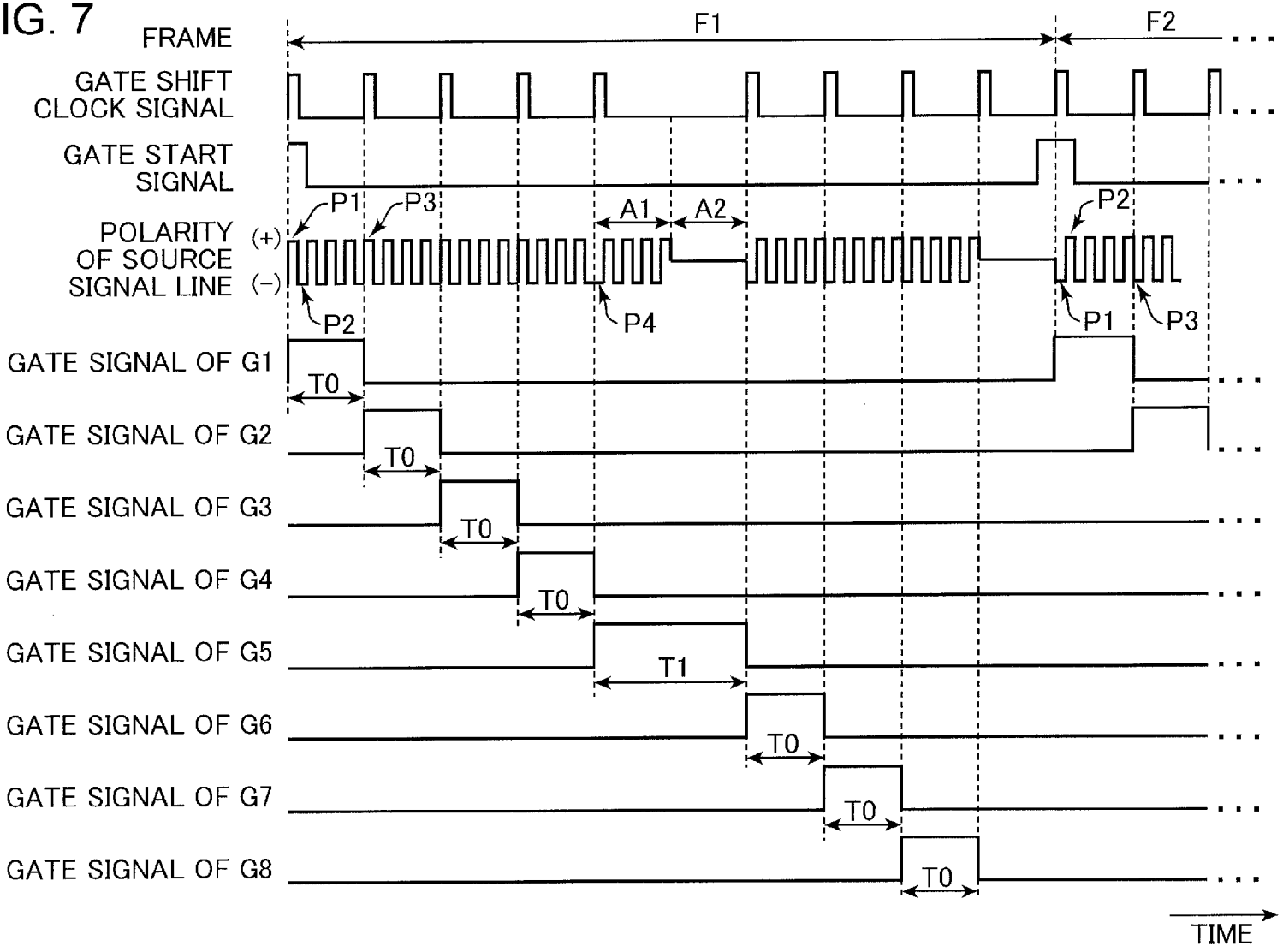
FIG. 7 is a timing chart showing signals of respective parts in the intermediate inversion drive mode illustrated in FIG. 5 according to this embodiment.

FIG. 7 is a timing chart showing signals of respective parts in the intermediate inversion drive mode illustrated in FIG. 5 according to this embodiment. The voltage application period to the pixel electrodes in this embodiment is now described with reference to FIG. 1, FIG. 5, and FIG. 7.

In FIG. 7, when the gate start signal is a high level, the gate signal of the gate signal line G1 becomes a high level in synchronization with the gate shift clock signal, and is kept a high level during the width of one horizontal period T0 up to the subsequent gate shift clock signal. This gate signal, as shown in FIG. 7, shifts toward the gate signal line G8, synchronizing with the gate shift clock signal. One horizontal period T0 is also referred to as a reference time T0, hereinafter.

With regard to the polarity of the source signal lines, the applied voltage pulse P1 of the pixel electrode (as "pixel electrode X") connected to the gate signal line G1 and the source signal line S1 is of a positive polarity in the frame F1, and is of a negative polarity in the subsequent frame F2, and AC drive is being performed. Moreover, the applied voltage pulse P2 of the pixel electrode connected to the gate signal line G1 and the source signal line S2 which is adjacent to the right side of the pixel electrode X is of a negative polarity in the frame F1, and is of a positive polarity in the subsequent frame F2, and AC drive is being performed in polarity that is opposite to the pixel electrode X. Moreover, the applied voltage pulse P3 of the pixel electrode connected to the gate signal line G2 and the source signal line S1 which is adjacent to the lower side of the pixel electrode X is of a positive polarity in the frame F1, and is of a negative polarity in the subsequent frame F2, and AC drive is being performed in the same polarity as the pixel electrode X. As described above, the polarity of the applied voltage to the pixel electrodes in the frame F1 of FIG. 7 is of the polar state shown in FIG. 5.

Note that, the applied voltage pulse P2 is illustrated as being output subsequent to the applied voltage pulse P1 in order to show the difference in polarity in the "polarity of the source signal lines" of FIG. 7. Nevertheless, in general, during one horizontal period (period in which the gate signal of the gate signal line G1 is being output for instance), the source driver 14 simultaneously and continuously outputs voltages to the source signal lines S1 to S8. In other words, the applied voltage pulses P1, P2 are simultaneously and continuously output while the gate signal of the gate signal line G1 is being output. With respect to this point, the same applies to FIG. 8 to FIG. 10 described later.

In FIG. 5, voltages are applied, in order of the gate signal lines G1 to G8, to the respective pixel electrodes connected to the source signal line S1 for instance. In addition, in the intermediate inversion drive mode shown in FIG. 5, voltages of the same polarity (positive) are applied to the source signal line S1 from the gate signal line G1 to the gate signal line G4. In other words, each voltage of the same polarity as the voltage that was applied immediately before is applied from the gate signal line G2 to the gate signal line G4. Meanwhile, as shown in FIG. 5, in the gate signal line G5, the polarity (negative) of the applied voltage to the source signal line S1 is inverted from the immediately preceding polarity (positive). In FIG. 7, the applied voltage pulse P4 of the pixel electrode connected to the gate signal line G5 and the source signal line S1 is of a negative polarity in the frame F1. In addition, from the gate signal line G5 to the gate signal line G8, as shown in FIG. 5, voltages of the same polarity (negative) are applied to the source signal line S1.

As described above, while a voltage of the same polarity as the immediately preceding applied voltage was applied to the source signal lines S1 to S8 from the gate signal lines G2 to G4, in the gate signal line G5, the polarity of the applied voltage is inverted from the immediately preceding (gate signal line G4) polarity. Thus, the responsiveness of the applied voltage to the pixel electrode in the gate signal line G5 may deteriorate in comparison to the responsiveness of the gate signal lines G2 to G4. Thus, unless some kind of measure is taken against this deterioration in responsiveness, lateral streaks along the gate signal line G5 may arise in the image displayed on the liquid crystal display panel 12, and the display quality of the image may thereby deteriorate.

Thus, in this embodiment, in order to compensate the deteriorated responsiveness, the controller 11 controls the gate driver 13 to once stop the output of the gate shift clock signal as shown in FIG. 7. Thus, the application of voltage to the subsequent gate signal line G6 may be delayed by one horizontal period T0. Accordingly, the high level period (that is, the voltage application period) T1 of the gate signal of the gate signal line G5 becomes T1=2×T0. In other words, the controller 11 sets the high level period (that is, the voltage application period) T1 of the gate signal of the gate signal line G5 to be a time that is longer than the reference time T0. Consequently, it is possible to secure a sufficient time as the voltage application period to the pixel electrodes connected to the gate signal line G5. In this embodiment, the pixel electrodes connected to the gate signal line G5 correspond to an example of the inverted electrode, and the pixel electrodes connected to the gate signal lines G2 to G4, G6 to G8 correspond to an example of the equivalent electrode.

As described above, in this embodiment, the controller 11 switches the drive mode of the voltage application to the pixel electrodes between the column inversion drive mode and the dot inversion drive mode via the intermediate inversion drive mode. The intermediate inversion drive mode is a drive mode of inverting polarity of a voltage applied to the pixel electrodes connected to one source signal line every plural gate signal lines, inverting polarity of a voltage applied to the pixel electrodes connected to mutually adjacent source signal lines and connected to the same gate signal line, and inverting polarity of a voltage applied to the respective pixel electrodes for each frame. In other words, in the intermediate inversion drive mode, the polar state of the applied voltage is an intermediate polar state between the column inversion drive mode and the dot inversion drive mode.

Accordingly, in comparison to cases of directly switching from the column inversion drive mode to the dot inversion drive mode, or directly switching from the dot inversion drive mode to the column inversion drive mode, the drive mode may be switched smoothly. Thus, according to this embodiment, it is possible to inhibit the deterioration in the image quality, due to the generation of a boundary as a result of images displayed on the liquid crystal display panel 12 not being consecutive, during the switching of the drive mode.

Moreover, in this embodiment, in the intermediate inversion drive mode, when a voltage is sequentially applied, for each of the gate signal lines G1 to G8, to the pixel electrodes connected to the source signal line S1 for instance, the controller 11 causes the voltage application period T1 to the pixel electrode (the pixel electrodes connected to the gate signal line G5 in FIG. 5 for instance) in which the polarity of the applied voltage is inverted from the immediately preceding pixel electrode to be longer in comparison to the voltage application period T0 to the pixel electrodes (pixel electrodes connected to gate signal lines other than the gate signal line G5 in FIG. 5 for instance) in which the polarity of the applied voltage is the same as the immediately preceding pixel electrode. The responsiveness to the applied voltage may deteriorate in the pixel electrode, in which the polarity of the applied voltage is inverted from the immediately preceding pixel electrode, in comparison to the pixel electrode, in which the polarity of the applied voltage is the same as the immediately preceding pixel electrode. Thus, if the voltage application period is set to the same value, lateral streaks may arise along the gate signal line G5 to deteriorate the image quality. Meanwhile, in this embodiment, since the voltage application period T1 is set to be longer in comparison to the voltage application period T0, it is possible to compensate the deterioration in the responsiveness to the applied voltage. Accordingly, in this embodiment, it is possible to inhibit the generation of lateral streaks along the gate signal line G5, and prevent the deterioration in the image quality.

Note that, in the above embodiment, as shown in FIG. 7, the source driver 14 outputs voltages to the source signal lines S1 to S8 during the first half period A1 (=T0) of the high level period (voltage application period) T1 to the gate signal line G5, and does not output voltages to the source signal lines S1 to S8 during the period A2. Nevertheless, since a gate signal is also output to the gate signal line G5 during the period A2, the responsiveness of liquid crystals to the voltage application is ongoing. Consequently, the deterioration in responsiveness is compensated.

Meanwhile, as another embodiment, the voltage application to the source signal lines S1 to S8 may be continued during the high level period (voltage application period) T1 of the gate signal of the gate signal line G5 that was extended due to the delay.

(Another Embodiment of the First Embodiment)

Figure 8:
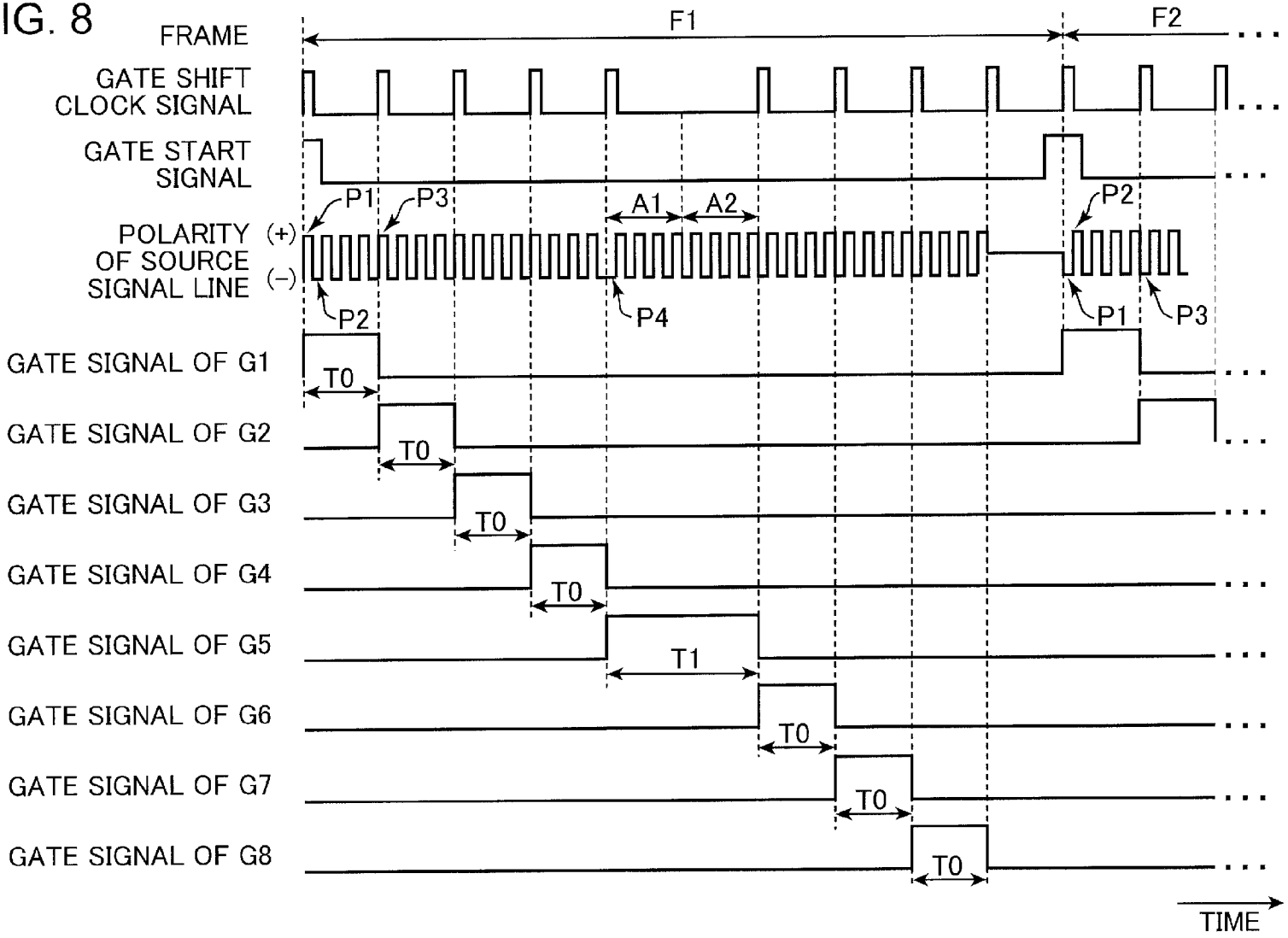
FIG. 8 is a timing chart showing signals of respective parts in the intermediate inversion drive mode illustrated in FIG. 5 according to another embodiment.

FIG. 8 is a timing chart showing signals of respective parts in the intermediate inversion drive mode illustrated in FIG. 5 according to another embodiment. The voltage application period to the pixel electrodes in the other embodiment is now described with reference to FIG. 1, FIG. 5, and FIG. 8.

In the above first embodiment shown in FIG. 7, a voltage was output from the source driver 14 to the source signal lines S1 to S8 during the first-half period A1 of the high level period (voltage application period) T1 of the gate signal of the gate signal line G5. Meanwhile, in the embodiment shown in FIG. 8, the controller 11 controls the source driver 14 to continue the voltage application to the source signal lines S1 to S8 during the high level period (voltage application period) T1 of the gate signal of the gate signal line G5. In other words, a voltage is output from the source driver 14 to the source signal lines S1 to S8 not only during the period A1 of the high level period (voltage application period) T1 of the gate signal line G5, but also during the subsequent period A2. Note that, other than the voltage output being continued during the period A2, FIG. 8 is the same as FIG. 7. In the embodiment shown in FIG. 8, the pixel electrodes connected to the gate signal line G5 correspond to an example of the inverted electrode, and the pixel electrodes connected to the gate signal lines G2 to G4, G6 to G8 correspond to an example of the equivalent electrode.

Consequently, in the embodiment shown in FIG. 8, it is possible to more favorably compensate the deterioration in responsiveness of the applied voltage to the pixel electrodes connected to the gate signal line G5. Thus, also with the embodiment shown in FIG. 8, it is possible to inhibit the generation of lateral streaks along the gate signal line G5 in the images displayed on the liquid crystal display panel 12, and thereby inhibit the excessive deterioration in the display quality of the image.

In the above first embodiment and the other embodiment shown in FIG. 8, the deterioration in responsiveness of the applied voltage to the pixel electrodes in the intermediate inversion drive mode shown in FIG. 5 has been described. Nevertheless, also in the intermediate inversion drive mode shown in FIG. 6, deterioration in responsiveness of the applied voltage similarly occurs. In other words, in FIG. 6, the polarity of the applied voltage to the pixel electrodes connected to the gate signal lines G2, G4, G6, G8 is each the same as the polarity of the applied voltage to the pixel electrodes connected to the immediately preceding gate signal lines G1, G3, G5, G7. Meanwhile, the polarity of the applied voltage to the pixel electrodes connected to the gate signal lines G3, G5, G7 is each inverted from the polarity of the applied voltage to the pixel electrodes connected to the immediately preceding gate signal lines G2, G4, G6. Accordingly, the high level period (voltage application period) of the gate signal of the gate signal lines G3, G5, G7 may be extended as with the foregoing embodiment.

Note that the polarity of the applied voltage to the pixel electrodes connected to the gate signal line G1 in FIG. 6 becomes the same as the polarity of the last applied voltage (gate signal line G8) of the immediately preceding frame when the polar state of the immediately preceding frame is a polar state which is an inversion of FIG. 6. For example, when this is the source signal line S1, it becomes a positive polarity. Accordingly, in the foregoing case, the high level period of the gate signal of the gate signal line G1 does not have to be extended.

Moreover, the polarity of the applied voltage to the pixel electrodes connected to the gate signal line G1 in FIG. 6 is inverted from the polarity of the last applied voltage (gate signal line G8) of the immediately preceding frame when the polar state of the immediately preceding frame is the polar state of FIG. 5. For example, in the case of the source signal line S1, it is inverted from a negative polarity to a positive polarity. Accordingly, in the foregoing case, the high level period (voltage application period) of the gate signal of the gate signal line G1 may be extended.

Moreover, the polarity of the applied voltage to the pixel electrodes connected to the gate signal line G1 in FIG. 6 becomes the same as the polarity of the last applied voltage (gate signal line G8) of the immediately preceding frame when the polar state of the immediately preceding frame is a polar state which is an inversion of FIG. 5. For example, in the case of the source signal line S1, it becomes a positive polarity. Accordingly, in the foregoing case, the high level period (voltage application period) of the gate signal of the gate signal line G1 does not have to be extended.

Moreover, in the intermediate inversion drive mode, when the inversion pattern is switched in two consecutive frames, the degree of deterioration in responsiveness of the applied voltage in the frame immediately after the switching may differ depending on the pixel electrode. Still another embodiment is described below.

(Still Another Embodiment of the First Embodiment)

Figure 9:
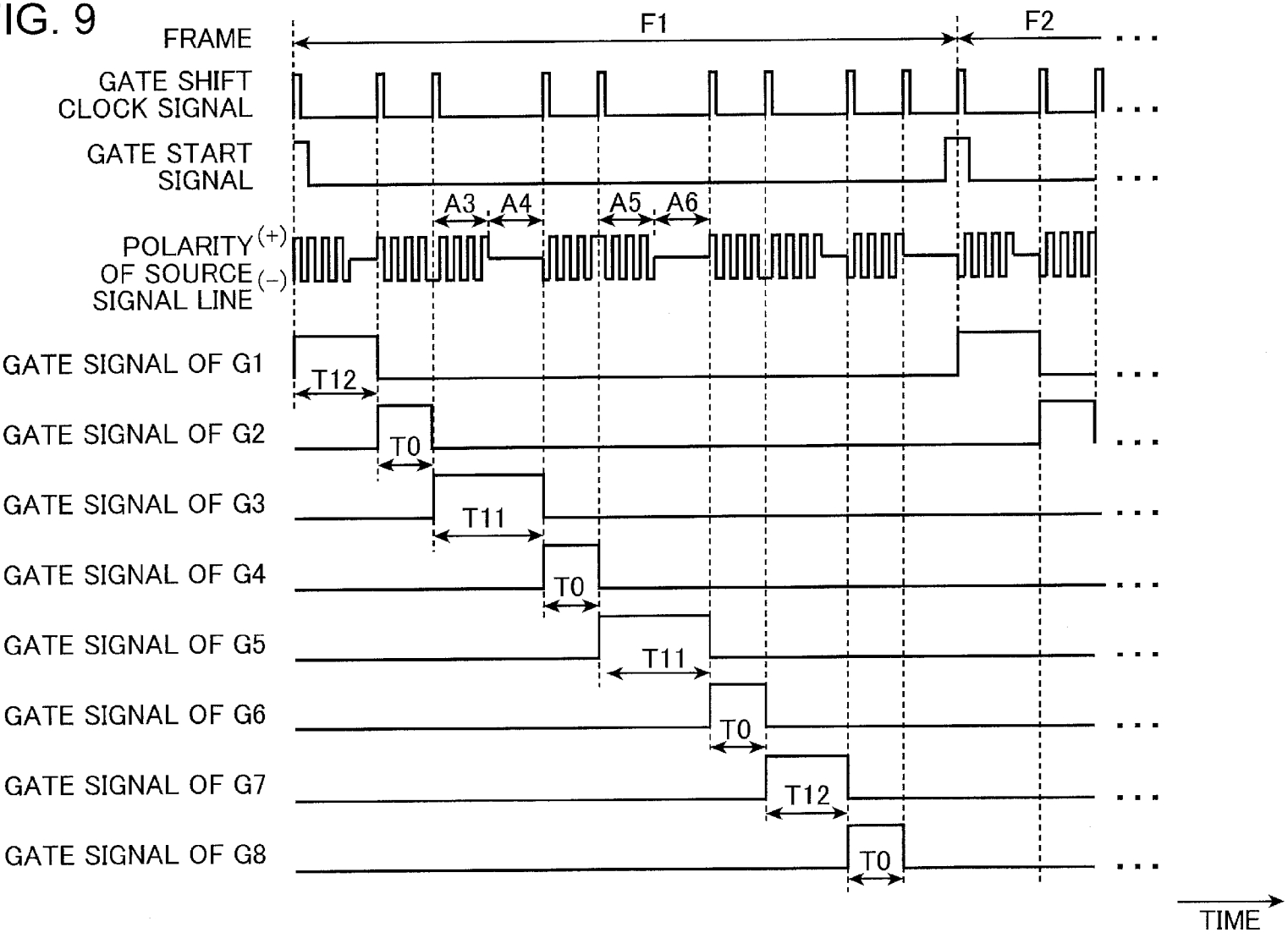
FIG. 9 is a timing chart showing signals of respective parts when a different inversion pattern of the intermediate inversion drive mode is used according to yet another embodiment.

FIG. 9 is a timing chart showing signals of respective parts when a different inversion pattern of the intermediate inversion drive mode is used according to still another embodiment. With reference to FIG. 5, FIG. 6, and FIG. 9, a description is made regarding the voltage application period that is controlled by the controller 11, in the intermediate inversion drive mode, in a case where the inversion pattern shown in FIG. 6 is used in a frame (hereinafter referred to as the "second frame" in the description with reference to FIG. 5, FIG. 6, and FIG. 9) subsequent to a frame (hereinafter referred to as the "first frame" in the description with reference to FIG. 5, FIG. 6, and FIG. 9) in which the inversion pattern shown in FIG. 5 is used.

In FIG. 5 and FIG. 6, voltages are applied, in order of the gate signal lines G1 to G8, to the pixel electrodes connected to the source signal line S1. At this time, in the second frame, as shown in FIG. 6, each of the polarities of the applied voltages to the pixel electrodes connected to the gate signal lines G2, G4, G6, G8 is the same as each of the polarities of the applied voltages to the pixel electrodes connected to the gate signal lines G1, G3, G5, G7 to each of which the voltage is applied immediately before.

Meanwhile, the polarity of the applied voltage to the pixel electrodes connected to the gate signal lines G3, G5, G7 is each inverted from the polarity of the applied voltage to the pixel electrodes connected to the gate signal lines G2, G4, G6 to which a voltage is applied immediately before. Moreover, the polarity (positive) of the applied voltage to the pixel electrodes connected to the gate signal line G1 in the second frame (FIG. 6) is inverted from the polarity (negative) of the applied voltage to the pixel electrodes connected to the gate signal line G8 to which a voltage was applied last in the immediately preceding first frame (FIG. 5).

Accordingly, in comparison to the pixel electrodes connected to the gate signal lines G2, G4, G6, G8 to which is applied the voltage of the same polarity as immediately before, the responsiveness to the applied voltage may deteriorate in the pixel electrodes connected to the gate signal lines G1, G3, G5, G7.

Here, the pixel electrodes connected to the gate signal lines G1, G3, G5, G7 additionally include pixel electrodes having different degrees of deterioration in responsiveness to the applied voltage. In other words, the polarity of the applied voltage to the pixel electrodes connected to the gate signal lines G3, G5 in the second frame (FIG. 6) is inverted from the polarity in the immediately preceding first frame (FIG. 5). Meanwhile, the polarity of the applied voltage to the pixel electrodes connected to the gate signal lines G1, G7 in the second frame (FIG. 6) is the same as the polarity in the immediately preceding first frame (FIG. 5). Accordingly, the responsiveness to the applied voltage to the pixel electrodes connected to the gate signal lines G3, G5 may deteriorate in comparison to the responsiveness to the applied voltage to the pixel electrodes connected to the gate signal lines G1, G7.

Thus, in the second frame, if the voltage application period to all pixel electrodes is set to the reference time T0, as described above, lateral streaks may arise in the gate signal lines G1, G3, G5, G7. Meanwhile, if the voltage application period to the pixel electrodes connected to the gate signal lines G1, G3, G5, G7 is set to be longer by the same duration in comparison to the reference time T0, lateral streaks may arise due to the difference between the gate signal lines G1, G7 and the gate signal lines G3, G5.

Thus, in the second frame (frame F1 of FIG. 9), as shown in FIG. 9, the controller 11 causes the voltage application period T12 to the pixel electrodes connected to the gate signal lines G1, G7 to be longer in comparison to the voltage application period T0 to the pixel electrodes connected to the gate signal lines G2, G4, G6, G8, and additionally causes the voltage application period T11 to the pixel electrodes connected to the gate signal lines G3, G5 to be longer than the voltage application period T12. In other words, the controller 11 controls the voltage application period to realize T0<T12<T11. In the embodiment shown in FIG. 9, the pixels connected to the gate signal lines G2, G4, G6, G8 correspond to an example of the equivalent electrode, the pixel electrodes connected to the gate signal lines G1, G3, G5, G7 correspond to an example of the inverted electrode, the pixel electrodes connected to the gate signal lines G3, G5 correspond to an example of the first pixel electrode, and the pixel electrodes connected to the gate signal lines G1, G7 correspond to an example of the second pixel electrode.

As described above, in the embodiment shown in FIG. 9, by causing the voltage application period to be T0<T12<T11, it is possible to compensate the deterioration in responsiveness to the applied voltage to the pixel electrodes connected to the gate signal lines G1, G3, G5, G7. Accordingly, in this embodiment, it is possible to inhibit the generation of lateral streaks along the gate signal lines G1, G3, G5, G7 in the images displayed on the liquid crystal display panel 12. Consequently, it is possible to inhibit the excessive deterioration in the display quality of the image.

Note that, in the embodiment shown in FIG. 9, out of the high level period (voltage application period) T11 to the gate signal line G3, voltage application to the source signal lines S1 to S8 is performed in the period A3, and a voltage is not output from the source driver 14 to the source signal lines S1 to S8 in the period A4. Further, out of the high level period (voltage application period) T11 to the gate signal line G5, voltage application to the source signal lines S1 to S8 is performed in the period A5, and a voltage is not output from the source driver 14 to the source signal lines S1 to S8 in the period A6. Nevertheless, since gate signals are output to the gate signal lines G3, G5 even during the periods A4, A6, the responsiveness of liquid crystals to the voltage application is ongoing. Consequently, the deterioration in responsiveness is compensated.

(Modified Embodiment of FIG. 9)

Figure 10:
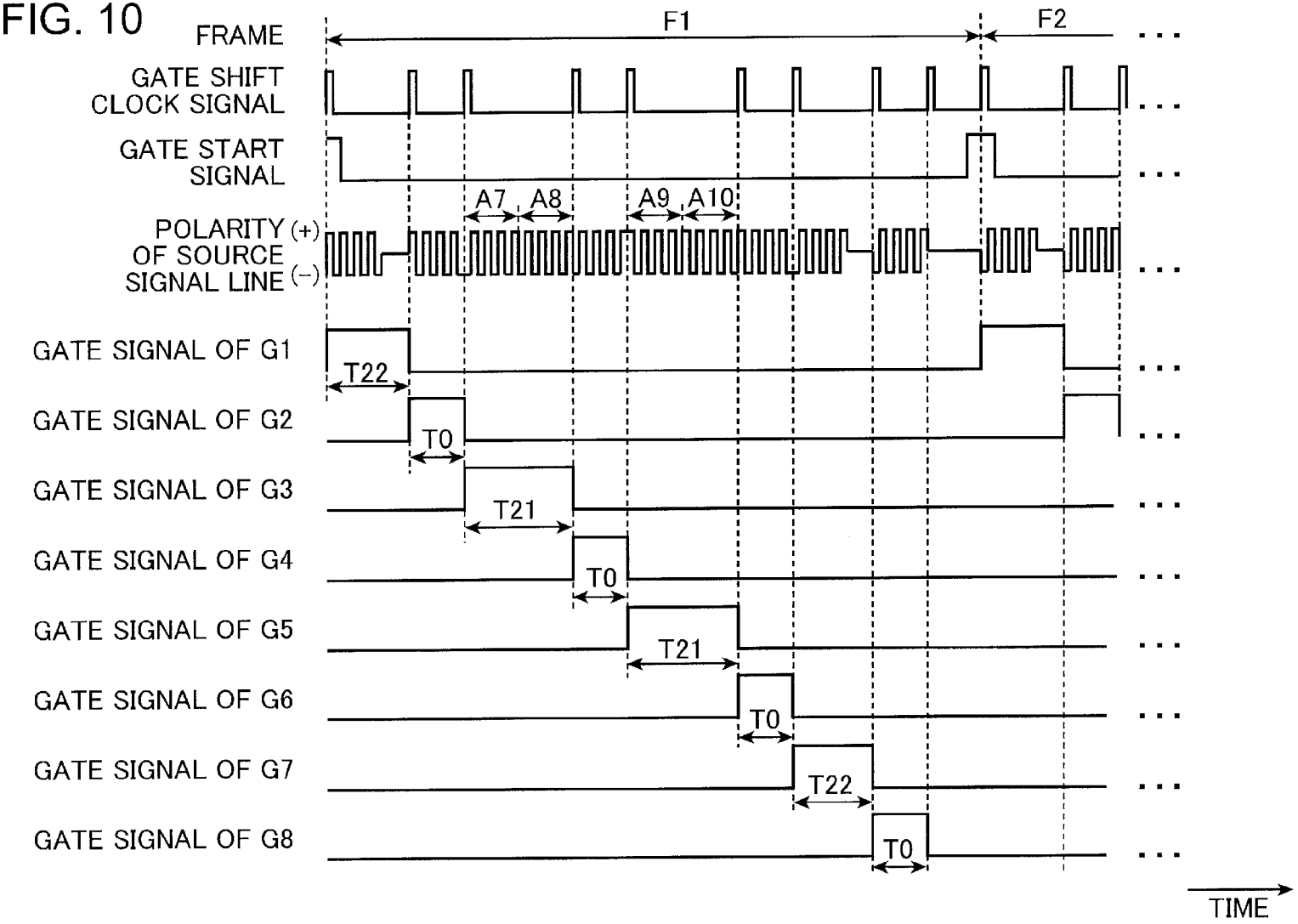
FIG. 10 is a timing chart showing signals of respective parts when a different inversion pattern of the intermediate inversion drive mode is used according to an embodiment, which is a modification of FIG. 9.

FIG. 10 is a timing chart showing signals of respective parts when a different inversion pattern of the intermediate inversion drive mode is used according to an embodiment, which is a modification of FIG. 9. With reference to FIG. 5, FIG. 6, and FIG. 10, a description is made regarding the voltage application period that is controlled by the controller 11, in the intermediate inversion drive mode, in a case where the inversion pattern shown in FIG. 6 is used in a frame (hereinafter referred to as the "second frame" in the description with reference to FIG. 5, FIG. 6, and FIG. 10) subsequent to a frame (hereinafter referred to as the "first frame" in the description with reference to FIG. 5, FIG. 6, and FIG. 10) in which the inversion pattern shown in FIG. 5 is used.

In the embodiment of FIG. 10, as with the embodiment of FIG. 9, in the second frame (frame F1 of FIG. 10), the controller 11 causes the voltage application period T22 to the pixel electrodes connected to the gate signal lines G1, G7 to be longer in comparison to the voltage application period T0 to the pixel electrodes connected to the gate signal lines G2, G4, G6, G8, and additionally causes the voltage application period T21 to the pixel electrodes connected to the gate signal lines G3, G5 to be longer than the voltage application period T22. In other words, the controller 11 controls the gate driver 13 to establish T0<T22<T21 for the voltage application period. In FIG. 10, the controller 11 additionally performs control to realize T21=T0×2, and twice applies voltages to the pixel electrodes connected to the gate signal lines G3, G5 via the source signal lines S1 to S8.

In other words, in the embodiment shown in FIG. 10, of the high level period (voltage application period) T21 to the gate signal line G3, the source driver 14 not only continues the voltage output to the source signal lines S1 to S8 in the period A7, but also continues such voltage output in the subsequent period A8. Moreover, of the high level period (voltage application period) T21 to the gate signal line G5, the source driver 14 not only continues the voltage output to the source signal lines S1 to S8 in the period A9, but also continues such voltage output in the subsequent period A10. In the embodiment shown in FIG. 10, the pixel electrodes connected to the gate signal lines G2, G4, G6, G8 correspond to an example of the equivalent electrode, the pixel electrodes connected to the gate signal lines G1, G3, G5, G7 correspond to an example of the inverted electrode, the pixel electrodes connected to the gate signal lines G3, G5 correspond to an example of the first pixel electrode, and the pixel electrodes connected to the gate signal lines G1, G7 correspond to an example of the second pixel electrode.

Consequently, in the embodiment shown in FIG. 10, in comparison to the embodiment shown in FIG. 9, it is possible to more favorably compensate the deterioration in responsiveness to the applied voltage to the pixel electrodes connected to the gate signal lines G3, G5. Thus, also with the embodiment shown in FIG. 10, it is possible to inhibit the generation of lateral streaks along the gate signal lines G3, G5 in the images displayed on the liquid crystal display panel 12, and thereby inhibit the excessive deterioration in the display quality of the image.

(Switching Operation of Drive Mode in Each of Foregoing Embodiments)

Figure 11:
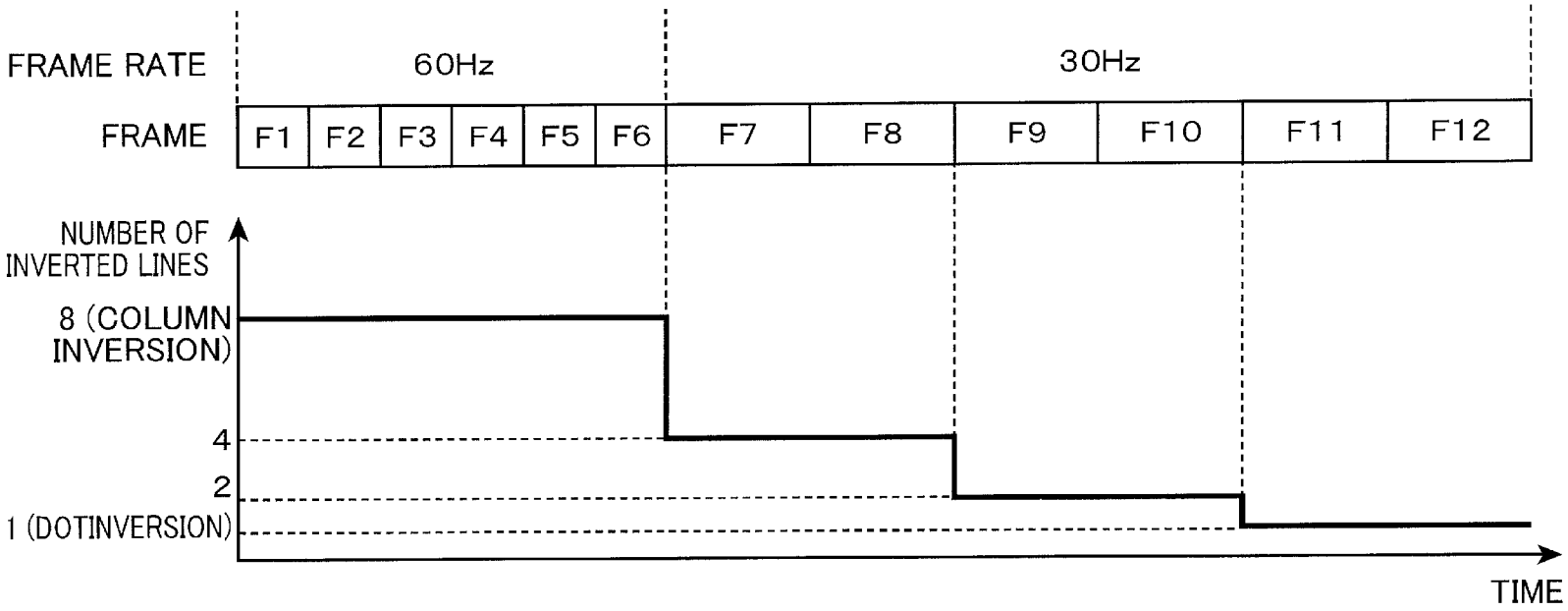
FIG. 11 is a timing chart schematically showing a transfer process of the drive mode.

FIG. 11 is a timing chart schematically showing a transfer process of the drive mode in each of the foregoing embodiments. FIGS. 12A and 12B are diagrams schematically showing polarities of applied voltages of respective pixel electrodes in the column inversion drive mode. FIGS. 13A and 13B are diagrams schematically showing polarities of applied voltages of respective pixel electrodes in the intermediate inversion drive mode. In the intermediate inversion drive mode of FIGS. 13A and 13B, an inversion pattern in which the polarity of the applied voltage is inverted every four gate signal lines is used. FIGS. 14A and 14B are diagrams schematically showing polarities of applied voltages of respective pixel electrodes in the intermediate inversion drive mode. In the intermediate inversion drive mode of FIGS. 14A and 14B, an inversion pattern in which the polarity of the applied voltage is inverted every two gate signal lines is used. FIGS. 15A and 15B are diagrams schematically showing polarities of applied voltages of respective pixel electrodes in the dot inversion drive mode. The polarities of FIGS. 12B, 13B, 14B, 15B respectively show inverted states of the polarities of FIGS. 12A, 13A, 14A, 15A. A specific switching operation of the drive mode in each of the foregoing embodiments is now described with reference to FIGS. 1 and 11 to 15B.

In FIG. 11, the frame rate in the frames F1 to F6 is 60 Hz. Thus, the controller 11 sets the drive mode to be the column inversion drive mode shown in FIGS. 12A and 12B. In other words, the controller 11 alternately uses the polar state shown in FIG. 12A and the polar state shown in FIG. 12B. For example, the frames F1, F3, F5 become the polar state shown in FIG. 12A, and the frames F2, F4, F6 become the polar state shown in FIG. 12B.

In the frame F7, the frame rate is switched to 30 Hz. Thus, the controller 11 switches the drive mode to the intermediate inversion drive mode. Here, the number of gate signal lines is n=8. Thus, this becomes (n/2)=4. Therefore, as the intermediate inversion drive mode, the controller 11 foremost uses the inversion pattern shown in FIGS. 13A and 13B of inverting the polarity of the applied voltage every four gate signal lines. In other words, in FIG. 11, the number of inverted lines decreases from 8 (column inversion) to 4. Moreover, the controller 11 uses the same inversion pattern for two consecutive frames. Thus, for example, the frame F7 becomes the polar sate shown in FIG. 13A, and the frame F8 becomes the polar state shown in FIG. 13B.

Subsequently, in the frame F9, the controller 11 switches the inversion pattern of the intermediate inversion drive mode. Here, since n=8, it becomes $(n/2^2)=2$. Thus, the controller 11 uses, as the intermediate inversion drive mode, the inversion pattern shown in FIGS. 14A and 14B of inverting the polarity of the applied voltage every two gate signal lines. In other words, in FIG. 11, the number of inverted lines decreases from 4 to 2. Moreover, the controller 11 similarly uses the same inversion pattern for two consecutive frames. Thus, for example, the frame F9 becomes the polar state shown in FIG. 14A, and the frame F10 becomes the polar state shown in FIG. 14B. Note that, as shown in FIG. 11, the frame period (that is, frame period of frames F1 to F6) during the column inversion drive mode is shorter in comparison to the frame period (that is, frame period of frames F7 to F10) during the intermediate inversion drive mode.

Subsequently, in the frame F11, the controller 11 switches the inversion pattern of the intermediate inversion drive mode. Here, since n=8, it becomes $(n/2^3)=1$. Thus, the controller 11 switches from the intermediate inversion drive mode to the dot inversion drive mode shown in FIGS. 15A and 15B. In other words, in FIG. 11, the number of inverted lines decreases from 2 to 1 (dot inversion). Thus, for example, the frame F11 becomes the polar state shown in FIG. 15A, and the frame F12 becomes the polar state shown in FIG. 15B.

Note that, in FIG. 11, while the controller 11 uses the same inversion pattern for two consecutive frames in the intermediate inversion drive mode, the controller 11 may also use the same inversion pattern for three consecutive frames or more. In other words, the controller 11 may use the same inversion pattern for at least two consecutive frames in the intermediate inversion drive mode. Note that, as a different embodiment, the controller 11 may also switch the inversion pattern for each frame in the intermediate inversion drive mode as described below.

(Different Switching Operation of Drive Mode)

Figure 16:
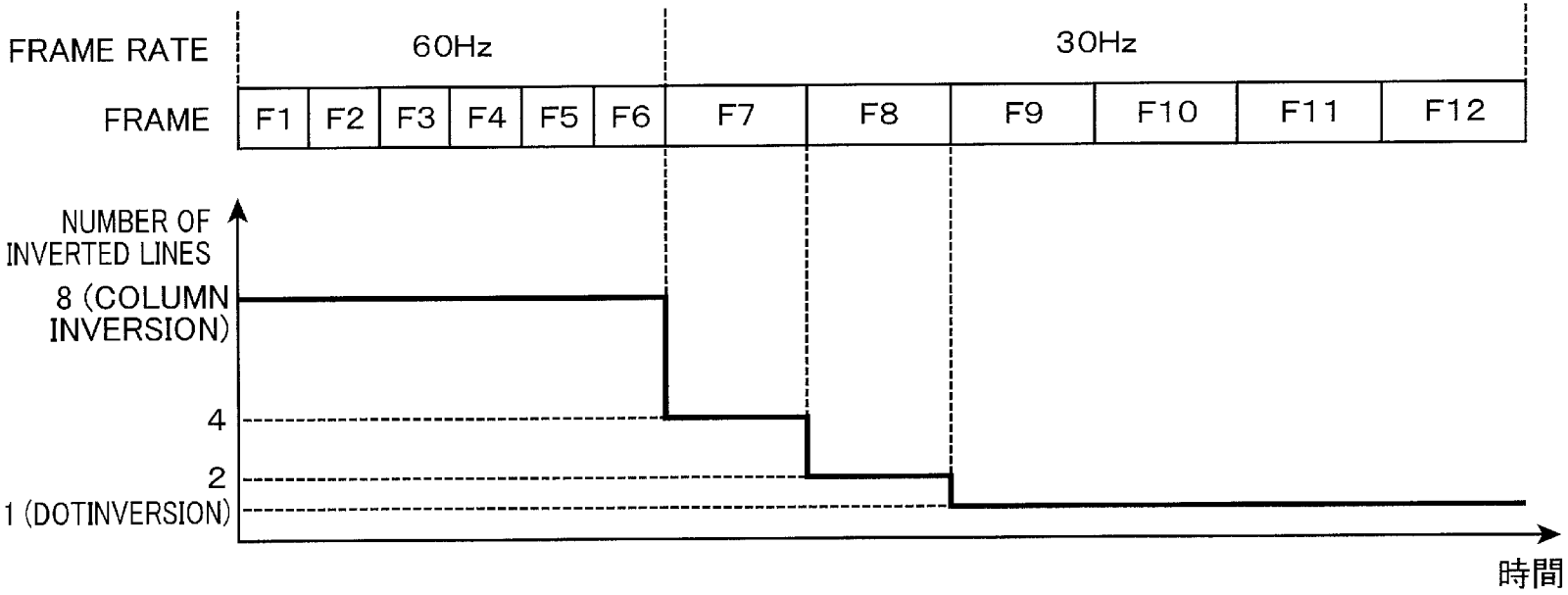
FIG. 16 is a timing chart schematically showing another embodiment of the transfer process of the drive mode.

FIG. 16 is a timing chart schematically showing another embodiment of the transfer process of the drive mode. FIG. 17 is a diagram schematically showing the polarity of the applied voltage of the respective pixel electrodes in the column inversion drive mode. FIG. 18 and FIG. 19 are diagrams schematically showing the polarity of the applied voltage of the respective pixel electrodes in the intermediate inversion drive mode. In the intermediate inversion drive mode of FIG. 18, an inversion pattern in which the polarity of the applied voltage is inverted every four gate signal lines is used. In the intermediate inversion drive mode of FIG. 19, an inversion pattern in which the polarity of the applied voltage is inverted every two gate signal lines is used. FIG. 20 is a diagram schematically showing the polarity of the applied voltage of the respective pixel electrodes in the dot inversion drive mode. The switching operation of the drive mode in another embodiment is now described with reference to FIG. 1 and FIG. 16 to FIG. 20.

In FIG. 16, the frame rate in the frames F1 to F6 is 60 Hz. Thus, as with the foregoing embodiment, the controller 11 sets the drive mode to be the column inversion drive mode shown in FIG. 17. In addition, for example, the frames F1, F3, F5 become the polar state shown in FIG. 12B, and the frames F2, F4, F6 become the polar state shown in FIG. 17.

In the frame F7, the frame rate is switched to 30 Hz. Thus, the controller 11 switches the drive mode to the intermediate inversion drive mode. Here, the number of gate signal lines is n=8. Thus, it becomes (n/2)=4. Therefore, as the intermediate inversion drive mode, the controller 11 foremost uses the inversion pattern shown in FIG. 18 of inverting the polarity of the applied voltage every four gate signal lines. In other words, in FIG. 16, the number of inverted lines decreases from 8 (column inversion) to 4. Consequently, the frame F7 becomes the polar state shown in FIG. 18.

Subsequently, in the frame F8, the controller 11 switches the drive pattern of the intermediate inversion drive mode. Here, since n=8, it becomes $(n/2^2)=2$. Thus, the controller 11 uses, as the intermediate inversion drive mode, the inversion pattern shown in FIG. 19 of inverting the polarity of the applied voltage every two gate signal lines. In other words, in FIG. 16, the number of inverted lines decreases from 4 to 2. Consequently, the frame F8 becomes the polar state shown in FIG. 19.

Subsequently, in the frame F9, the controller 11 switches the inversion pattern of the intermediate inversion drive mode. Here, since n=8, it becomes $(n/2^3)=1$. Thus, the controller 11 switches from the intermediate inversion drive mode to the dot inversion drive mode shown in FIG. 20. In other words, in FIG. 16, the number of inverted lines decreases from 2 to 1 (dot inversion). Thus, for example, the frames F9, F11 become the polar state shown in FIG. 20, and the frames F10, F12 become the polar state shown in FIG. 15A.

With the transfer process shown in FIG. 16 also, as with the transfer process shown in FIG. 11, in comparison to cases of directly switching from the column inversion drive mode to the dot inversion drive mode, or directly switching from the dot inversion drive mode to the column inversion drive mode, the drive mode may be switched smoothly, and it is possible to inhibit the deterioration in the image quality.

Here, in comparison to the transfer process of switching the inversion pattern for each frame as shown in FIG. 16, it is preferable to adopt the transfer process of using the same inversion pattern for at least two consecutive frames as shown in FIG. 11. This reason is described.

In the transfer process shown in FIG. 16 to FIG. 20, the transition of polarity of the applied voltage to the pixel electrodes connected to the source signal line S1, for instance, in the four consecutive frames from the frame F6 in the polar state shown in FIG. 17 to the frame F9 in the polar state shown in FIG. 20 is as follows.

The polarities of voltages applied to the pixel electrodes connected to the gate signal line G1 for example are inverted for each frame during the four frames of the frames F6 to F9. Meanwhile, the pixel electrodes connected to the gate signal line G2, for example, are of the same polarity for the two consecutive frames of the frames F8 and F9 as of the frame F9 shown in FIG. 20. Moreover, the pixel electrodes connected to the gate signal line G3, for example, are of the same polarity for the three consecutive frames of the frames F7 to F9 as of the frame F9 shown in FIG. 20. Moreover, the pixel electrodes connected to the gate signal line G6, for example, are of the same polarity for the four consecutive frames of the frames F6 to F9 as of the frame F9 shown in FIG. 20.

As described above, in the transfer process shown in FIG. 16 to FIG. 20, the difference in responsiveness to the applied voltage becomes the greatest between the pixel electrodes connected to the gate signal line G1, in which the polarity is inverted for each frame, and the pixel electrodes connected to the gate signal line G6, in which the polarity is the same for four consecutive frames, at the point in time of the frame F9 shown in FIG. 20.

Meanwhile, with the transfer process shown in FIG. 11 in which the same inversion pattern is used for at least two consecutive frames, the polarity of the applied voltage to all pixel electrodes is inverted between the frames that are used consecutively. Accordingly, the number of consecutive frames using the same polarity is limited to two frames in which the inversion pattern is switched. For example, among the pixel electrodes connected to the source signal line S1, the polarity of the pixel electrodes connected to the gate signal lines G3 to G6 are the same when the frame of the inversion pattern shown in FIG. 13B is switched to the frame of the inversion pattern shown in FIG. 14A. Nevertheless, when a frame of the inversion pattern shown in FIG. 14A is switched to a frame of the inversion pattern shown in FIG. 14B, all polarities are inverted since the inversion pattern is the same.

Accordingly, in the transfer process shown in FIG. 11, in comparison to the transfer process shown in FIG. 16 to FIG. 20, it is possible to inhibit the difference in responsiveness to the applied voltage among the respective pixel electrodes. Consequently, the brightness of the pixels may be easily made to be approximately the same level. Thus, the transfer process shown in FIG. 11 is more preferable than the transfer process shown in FIG. 16 to FIG. 20. This point is the same in the second embodiment described later.

(Others)

In the foregoing embodiment, as shown in FIG. 11 for example, in the frame F7 which is subsequent to the frame F6 in which the frame rate is 60 Hz, the frame rate is 30 Hz. However, an embodiment in which the frame rate gradually decreases may also be adopted. For example, an embodiment which decreases the frame rate in stages with the frame F7 being 50 Hz, the frame F8 being 40 Hz, and the frame F9 being 30 Hz. In such an embodiment also, the controller 11 detects that the frame rate in the frame F7 is less than 60 Hz. Accordingly, the controller 11 switches the drive mode from the column inversion drive mode to the intermediate inversion drive mode. Consequently, the same operation as the foregoing embodiment is performed.

In the foregoing embodiment, a case where the number of gate signal lines is n=8 has been described for simplifying the description. Nevertheless, n=8 is merely an example, and this may be another value such as n=1024, for instance.

In the intermediate inversion drive mode shown in FIG. 5 of the foregoing embodiment, an inversion pattern in which the polarity of the applied voltage to the pixel electrodes connected to one source signal line is inverted once is used. Moreover, in the intermediate inversion drive mode shown in FIG. 6 of the foregoing embodiment, an inversion pattern in which the polarity of the applied voltage to the pixel electrodes connected to one source signal line is inverted twice is used. However, the polarity inversion pattern may be an inversion pattern that is different from FIG. 5 and FIG. 6.

In substitute for the inversion pattern of FIG. 5, an inversion pattern (first polarity inversion pattern) of inverting the polarity of the applied voltage to the pixel electrodes connected to one of the source signal lines every L gate signal lines (L is an integer that is greater than 2) may be used. In substitute for the inversion pattern of FIG. 6, an inversion pattern (second polarity inversion pattern) of inverting the polarity of the applied voltage to the pixel electrodes connected to one of the source signal lines every K gate signal lines (K is an integer that is not less than 2 and less than L) may be used. In substitute for the inversion pattern of FIG. 5, an inversion pattern (first polarity inversion pattern) of inverting the polarity of the applied voltage to the pixel electrodes connected to one source signal line M times (M is a positive integer) may be used. In substitute for the inversion pattern of FIG. 6, an inversion pattern (second polarity inversion pattern) of inverting the polarity of the applied voltage to the pixel electrodes connected to one of the source signal lines N times (N is an integer that is greater than M) may be used. Instead of using an inversion pattern of inverting the polarity every fixed number of gate signal lines such as K or L gate signal lines, an inversion pattern of inverting the polarity every different number of gate signal lines may be used.

In the foregoing embodiment, upon switching from the column inversion drive mode to the dot inversion drive mode, the controller 11 sequentially uses the inversion pattern of decreasing the number of gate signal lines, in which the polarity is to be inverted, ½ at a time in the intermediate inversion drive mode. In other words, if the number n of gate signal lines is n=1024 for example, the controller 11 sequentially uses, in the intermediate inversion drive mode, inversion patterns of inverting the polarity every 512, 256, 128, 64, 32, 16, 8, 4, and 2 gate signal lines. However, without limitation to ½ at a time, upon switching from the column inversion drive mode to the dot inversion drive mode, the controller 11 may sequentially use, in the intermediate inversion drive mode, inversion patterns of gradually decreasing, in a stepwise manner, the number of gate signal lines in which the polarity is to be inverted. Upon switching from the dot inversion drive mode to the column inversion drive mode, the controller 11 may similarly use inversion patterns of gradually increasing, in a stepwise manner, the number of gate signal lines in which the polarity is to be inverted.

In the foregoing embodiment, upon switching the drive mode between the column inversion drive mode and the dot inversion drive mode, the switching is performed via the intermediate inversion drive mode. However, the switching of the drive mode is not limited to be between the column inversion drive mode and the dot inversion drive mode.

As a modified embodiment of the foregoing embodiment, for example, an embodiment of switching the drive mode between the column inversion drive mode (FIG. 12) and the two-line inversion drive mode (FIG. 14) may also be adopted. In this case, the switching may be performed via the intermediate inversion drive mode shown in FIG. 13 for example. Consequently, in comparison to the switching between the drive mode shown in FIG. 12 and the drive mode shown in FIG. 14, the drive mode may be switched smoothly. In this modified embodiment, the column inversion drive mode (FIG. 12) corresponds to an example of the first drive mode, and the two-line inversion drive mode (FIG. 14) corresponds to an example of the second drive mode.

Note that, in this modified embodiment, the first drive mode is not limited to the column inversion drive mode (FIG. 12). The first drive mode may also be, for example, a drive mode of inverting the polarity of the applied voltage to the pixel electrodes connected to one of the source signal lines every X gate signal lines (X is an integer that is greater than L). Moreover, in this modified embodiment, the second drive mode is not limited to the two-line inversion drive mode (FIG. 14). The second drive mode may also be, for example, a drive mode of inverting the polarity of the applied voltage to the pixel electrodes connected to one of the source signal lines every Y gate signal lines (Y is an integer that is not less than 1 and less than K). Here, L and K are the integers described above.

In addition, in this modified embodiment, the first drive mode may also be, for example, a drive mode of inverting the polarity of the voltage applied to the pixel electrodes connected to one source signal line I times (I is an integer that is not less than 0 and less than M), and the second drive mode may also be a drive mode of inverting the polarity of the voltage applied to the pixel electrodes connected to one source signal line J times (J is an integer that is greater than N). Here, M and N are the integers described above.

As a different modified embodiment of the foregoing embodiment, for example, an embodiment of switching the drive mode between the four-line inversion drive mode (FIG. 13) and the dot inversion drive mode (FIG. 15) may also be adopted. In this case, the switching may be performed via the intermediate inversion drive mode shown in FIG. 14 for example. Consequently, in comparison to the direct switching between the drive mode shown in FIG. 13 and the drive mode shown in FIG. 15, the drive mode may be switched smoothly. In this different modified embodiment, the four-line inversion drive mode shown in FIG. 13 corresponds to an example of the first drive mode, and the dot inversion drive mode shown in FIG. 15 corresponds to an example of the second drive mode.

Note that, in this different modified embodiment, the first drive mode is not limited to the four-line inversion drive mode (FIG. 13). The first drive mode may also be, for example, a drive mode of inverting the polarity of the applied voltage to the pixel electrodes connected to one of the source signal lines every X gate signal lines (X is an integer that is greater than L). Moreover, in this different modified embodiment, the second drive mode is not limited to the dot inversion drive mode (FIG. 15). The second drive mode may also be, for example, a drive mode of inverting the polarity of the applied voltage to the pixel electrodes connected to one of the source signal lines every Y gate signal lines (Y is an integer that is not less than 1 and less than K). Here, L and K are the integers described above.

In addition, in this different modified embodiment, the first drive mode may also be, for example, a drive mode of inverting the polarity of the voltage applied to the pixel electrodes connected to one source signal line I times (I is an integer that is not less than 0 and less than M), and the second drive mode may also be a drive mode of inverting the polarity of the voltage applied to the pixel electrodes connected to one source signal line J times (J is an integer that is greater than N). Here, M and N are the integers described above.

(Second Embodiment)

Figure 21:
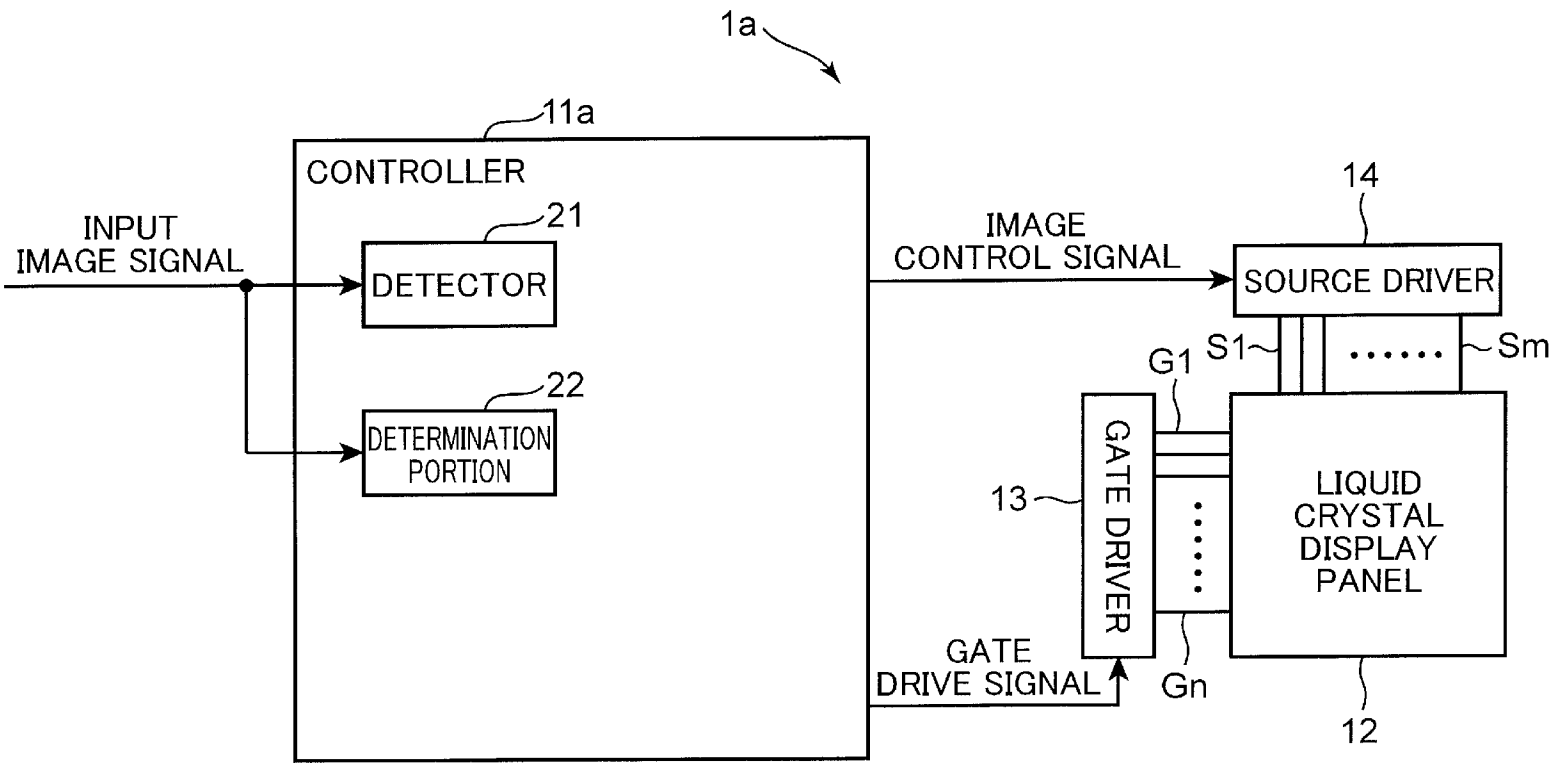
FIG. 21 is a block diagram showing a configuration of a liquid crystal display device of the second embodiment of the present application.

FIG. 21 is a block diagram showing a configuration of a liquid crystal display device of the second embodiment of the present application. Among the respective elements of the second embodiment, elements that are similar to those of the first embodiment are given similar reference numeral. As shown in FIG. 21, the liquid crystal display device 1*a* of the second embodiment includes a controller 11*a*, a liquid crystal display panel 12, a gate driver 13, and a source driver 14. Note that the configuration of the second embodiment is similar to the configuration of the first embodiment described with reference to FIG. 2 to FIG. 6. The second embodiment is now described mainly with regard to the differences in comparison to the first embodiment.

The controller 11*a* includes a detector 21 and a determination portion 22. The detector 21 detects, as the feature amount of the input image signal, the frame rate upon displaying images on the liquid crystal display panel 12. The determination portion 22 determines voltage levels to be applied to the pixel electrodes based on the signal level of the input image signal and the polarity of the applied voltage to the pixel electrodes. The controller 11*a* switches the drive mode based on the frame rate detected by the detector 21. The controller 11*a* generates an image control signal based on the voltage level determined by the determination portion 22, and outputs the generated image control signal to the source driver 14.

Specifically, the controller 11*a* switches the drive mode to the column inversion drive mode in a case where the frame rate detected by the detector 21 is equal to or higher than a reference value (in this embodiment, for instance, 60 Hz). Whereas, the controller 11*a* switches the drive mode to the dot inversion drive mode in a case where the frame rate detected by the detector 21 is less than the reference value.

In other words, the controller 11*a* switches the drive mode from the column inversion drive mode to the dot inversion drive mode when the frame rate of the input image signal is switched, for example, from 60 Hz to 30 Hz. Whereas, the controller 11*a* switches the drive mode from the dot inversion drive mode to the column inversion drive mode when the frame rate of the input image signal is switched, for example, from 30 Hz to 60 Hz.

Note that, as the feature amount of the input image signal, the detector 21 may also detect the moving amount of an object in the image displayed on the liquid crystal display panel 12 in substitute for, or in addition to, the frame rate. And, in a case where the moving amount detected by the detector 21 is equal to or greater than a threshold value (in this embodiment, ten pixels between temporally adjacent frames, for example), the controller 11*a* may switch the drive mode to the column inversion drive mode. Moreover, in a case where the moving amount detected by the detector 21 is less than the threshold value, the controller 11*a* may switch the drive mode to the dot inversion drive mode.

The controller 11*a* controls the gate driver 13 and the source driver 14 so that, upon switching the drive mode of the voltage application to the pixel electrodes between the column inversion drive mode and the dot inversion drive mode, such switching is performed via the intermediate inversion drive mode. In other words, the controller 11*a* does not directly switch from the column inversion drive mode to the dot inversion drive mode, or directly switch from the dot inversion drive mode to the column inversion drive mode.

The intermediate inversion drive mode is, as shown in FIG. 5 and FIG. 6, a drive mode of inverting polarity of a voltage applied to the pixel electrodes connected to one of the source signal lines every plural gate signal lines, and inverting polarity of a voltage applied to the pixel electrodes connected to mutually adjacent source signal lines and connected to the same gate signal line. In other words, in the intermediate inversion drive mode, the polar state of the applied voltage is an intermediate polar state between the column inversion drive mode and the dot inversion drive mode.

When the controller 11*a* switches the drive mode from the column inversion drive mode to the dot inversion drive mode, in the intermediate inversion drive mode, the controller 11*a* foremost uses the inversion pattern of inverting the polarity of the applied voltage every (n/2) gate signal lines when there are n-number of gate signal lines as shown in FIG. 2. Subsequently the controller 11*a* uses the inversion pattern of inverting the polarity of the applied voltage every ($n/2^2$) gate signal lines. The controller 11*a* thereafter uses the inversion pattern of inverting the polarity of the applied voltage every ($n/2^3$) gate signal lines.

As described above, the controller 11*a*, in this embodiment, sequentially uses an inversion pattern of reducing the number of gate signal lines, in which the polarity is inverted, ½ at a time in the intermediate inversion drive mode upon switching from the column inversion drive mode to the dot inversion drive mode. And, the controller 11*a* uses the inversion pattern of inverting the polarity of the applied voltage every two gate signal lines at the end of the intermediate inversion drive mode, and thereafter switches the drive mode to the dot inversion drive mode. Moreover, in the intermediate inversion drive mode, the controller 11*a* uses the same inversion pattern for at least two consecutive frames. Note that, when the controller 11*a* switches from the dot inversion drive mode to the column inversion drive mode, in the intermediate inversion drive mode, the controller 11*a* sequentially uses an inversion pattern of increasing the number of gate signal lines, in which the polarity is inverted, twofold at a time.

In the intermediate inversion drive mode shown in FIG. 5, the polarity of the voltage applied to the pixel electrodes connected to one source signal line is inverted once. To put it differently, in the intermediate inversion drive mode shown in FIG. 5, an inversion pattern of inverting the polarity of the applied voltage every four gate signal lines is used. In the intermediate inversion drive mode shown in FIG. 6, the polarity of the voltage applied to the pixel electrodes connected to one source signal line is inverted three times. To put it differently, in the intermediate inversion drive mode shown in FIG. 6, an inversion pattern of inverting the polarity of the applied voltage every two gate signal lines is used.

When the number of gate signal lines is n=8, upon switching from the column inversion drive mode shown in FIG. 3 to the dot inversion drive mode shown in FIG. 4, the controller 11*a*, in the intermediate inversion drive mode, uses the inversion pattern shown in FIG. 5 for at least two consecutive frames, and thereafter uses the inversion pattern shown in FIG. 6 for at least two consecutive frames. In this embodiment, the column inversion drive mode corresponds to an example of the first drive mode, the dot inversion drive mode corresponds to an example of the second drive mode, the inversion pattern of the intermediate inversion drive mode shown in FIG. 5 corresponds to an example of the first polarity inversion pattern, and the inversion pattern of the intermediate inversion drive mode shown in FIG. 6 corresponds to an example of the second polarity inversion pattern.

An example of the voltage level that is determined by the determination portion 22 of the controller 11*a*, in a case where a different inversion pattern is used in the intermediate inversion drive mode or in a case where the drive mode is switched, is now described.

Figure 22A:
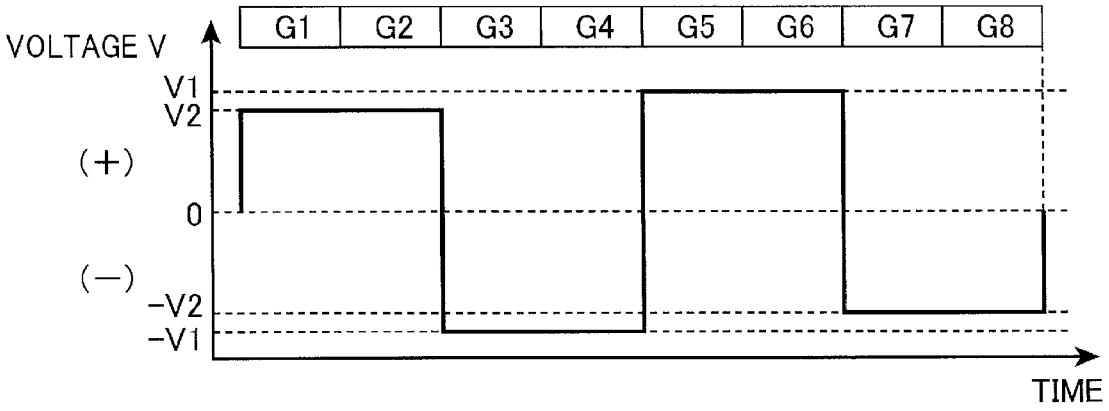
Figure 22B:
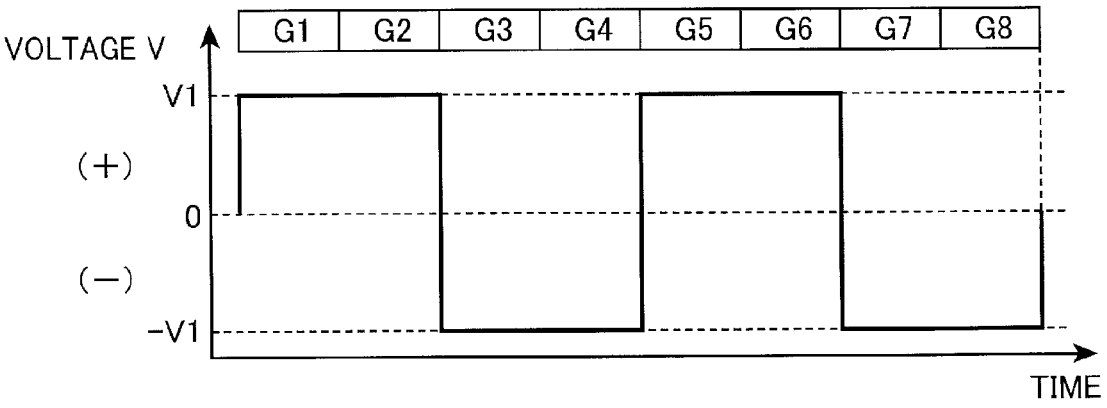

FIGS. 22A and 22B are diagrams showing the applied voltage to the source signal line S1 when a white image is to be displayed on the pixels of the pixel electrodes connected to the source signal line S1. FIG. 22A shows the voltage level in this embodiment. FIG. 22B shows, as a comparative example, the voltage level corresponding to the signal level of the input image signal. With reference to FIG. 5, FIG. 6, and FIGS. 22A and 22B, a description is made regarding the voltage level that is determined by the determination portion 22, in the intermediate inversion drive mode, in a case where the inversion pattern shown in FIG. 6 is used in a frame (hereinafter referred to as the "second frame" in the description with reference to FIG. 5, FIG. 6, and FIGS. 22A and 22B) which is subsequent to a frame (hereinafter referred to as the "first frame" in the description with reference to FIG. 5, FIG. 6, and FIGS. 22A and 22B) in which the inversion pattern shown in FIG. 5 is used.

In the first frame, the polarity of the applied voltage to the pixel electrodes connected to the source signal line S1 may be, as shown in FIG. 5, "+, +, +, +, −, −, −, −" in order of the gate signal lines G1 to G8. Meanwhile, in the subsequent second frame, as shown in FIG. 6, the polarity of the applied voltage to the pixel electrodes connected to the source signal line S1 may be "+, +, −, −, +, +, −, −" in order of the gate signal lines G1 to G8.

Accordingly, among the pixel electrodes connected to the source signal line S1, the polarity of the applied voltage to the pixel electrodes connected to the gate signal lines G1, G2, G7, G8 in the second frame may be the same polarity as the first frame. Meanwhile, among the pixel electrodes connected to the source signal line S1, the polarity of the applied voltage to the pixel electrodes connected to the gate signal lines G3, G4, G5, G6 in the second frame may be inverted from the first frame.

Relative to the polarity of the applied voltage in the first frame, with the pixel electrode in which the polarity of the applied voltage in the second frame is inverted, the responsiveness to the applied voltage may deteriorate, in comparison with the pixel electrode in which the polarity is not inverted and is the same.

Thus, in the second frame, as shown in FIG. 22B, if the same voltage V1 corresponding to the signal level of the input image signal is each applied, the brightness of the pixels of the pixel electrodes connected to the gate signal lines G3, G4, G5, G6 may decrease, in comparison to the pixels of the pixel electrodes connected to the gate signal lines G1, G2, G7, G8.

Thus, when the input image signal prescribes the same voltage level (white image in FIGS. 22A and 22B) for the pixel electrodes connected to the gate signal lines G1 to G8 in the second frame, the determination portion 22, as shown in FIG. 22A, determines the applied voltage V2 to the pixel electrodes connected to the gate signal lines G1, G2, G7, G8 to be a voltage that is lower than the applied voltage V1 to the pixel electrodes connected to the gate signal lines G3, G4, G5, G6. In other words, the determination portion 22 determines V1>V2. Consequently, the brightness of the pixels of the pixel electrodes connected to the gate signal lines G1 to G8 may be made to be approximately the same level. In the case shown in FIGS. 22A and 22B, the pixel electrodes connected to the gate signal lines G1, G2, G7, G8 correspond to an example of the equivalent electrode, the pixel electrodes connected to the gate signal lines G3, G4, G5, G6 correspond to an example of the inverted electrode, and the determination portion 22 corresponds to an example of the voltage determination portion.

Figure 23:
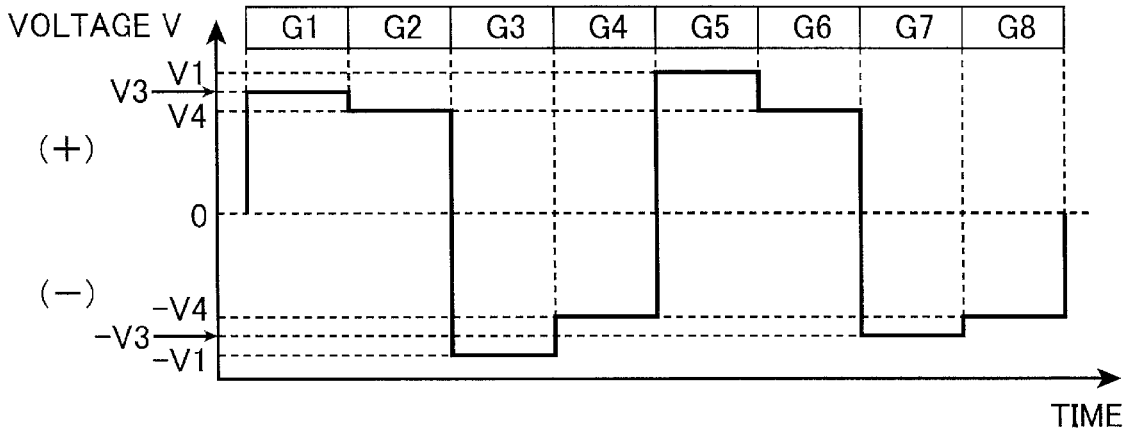
FIG. 23 is a diagram showing applied voltages to the source signal line when a white image is to be displayed on pixels of pixel electrodes connected to the source signal line in a case where a different inversion pattern is used in the intermediate inversion drive mode.

FIG. 23 is a diagram showing applied voltages to a source signal line when a white image is to be displayed on the pixels of the pixel electrodes connected to the source signal line S1 in a case where inversion patterns different from each other are used in the intermediate inversion drive mode. With reference to FIG. 5, FIG. 6, and FIG. 23, a description is made regarding the voltage level that is determined by the determination portion 22, in the intermediate inversion drive mode, in a case where the inversion pattern shown in FIG. 6 is used in a frame (hereinafter referred to as the "second frame" in the description with reference to FIG. 5, FIG. 6, and FIG. 23) that is subsequent to a frame (hereinafter referred to as the "first frame" in the description with reference to FIG. 5, FIG. 6, and FIG. 23) in which the inversion pattern shown in FIG. 5 is used.

A voltage is applied to the pixel electrodes connected to the source signal line S1 in order of the gate signal lines G1 to G8. At this time, in the second frame, as shown in FIG. 6, the polarity of the applied voltage to the pixel electrodes connected to the gate signal lines G2, G4, G6, G8 is each the same as the polarity of the applied voltage to the pixel electrodes connected to the gate signal lines G1, G3, G5, G7 to which a voltage is applied immediately before.

Meanwhile, the polarity of the applied voltage to the pixel electrodes connected to the gate signal lines G3, G5, G7 is each inverted from the polarity of the applied voltage to the pixel electrodes connected to the gate signal lines G2, G4, G6 to which a voltage is applied immediately before. Moreover, the polarity (positive) of the applied voltage to the pixel electrodes connected to the gate signal line G1 in the second frame (FIG. 6) is inverted from the polarity (negative) of the applied voltage to the pixel electrodes connected to the gate signal line G8 to which a voltage was applied last in the immediately preceding first frame (FIG. 5).

Accordingly, in comparison to the pixel electrodes connected to the gate signal lines G2, G4, G6, G8 to which is applied the voltage of the same polarity as immediately before, the responsiveness to the applied voltage may deteriorate in the pixel electrodes connected to the gate signal lines G1, G3, G5, G7.

Here, the pixel electrodes connected to the gate signal lines G1, G3, G5, G7 further include pixel electrodes having different levels of deterioration in responsiveness to the applied voltage. In other words, the polarity of the applied voltage to the pixel electrodes connected to the gate signal lines G3, G5 in the second frame (FIG. 6) is inverted from the polarity in the immediately preceding first frame (FIG. 5). Meanwhile, the polarity of the applied voltage to the pixel electrodes connected to the gate signal lines G1, G7 in the second frame (FIG. 6) is the same as the polarity in the immediately preceding first frame (FIG. 5). Accordingly, the responsiveness to the applied voltage to the pixel electrodes connected to the gate signal lines G3, G5 may deteriorate in comparison to the responsiveness to the applied voltage to the pixel electrodes connected to the gate signal lines G1, G7.

Thus, in the second frame, as shown in FIG. 22B, if the same voltage V1 corresponding to the signal level of the input image signal is each applied, in comparison to the pixels of the pixel electrodes connected to the gate signal lines G2, G4, G6, G8, the brightness of the pixels of the pixel electrodes connected to the gate signal lines G1, G3, G5, G7 may decrease, as described above. In addition, in comparison to the pixels of the pixel electrodes connected to the gate signal lines G1, G7, the brightness of the pixels of the pixel electrodes connected to the gate signal lines G3, G5 may decrease.

Therefore, when the input image signal prescribes the same voltage level (white image in FIG. 23) for the pixel electrodes connected to the gate signal lines G1 to G8 in the second frame, the determination portion 22, as shown in FIG. 23, determines the applied voltage V3 to the pixel electrodes connected to the gate signal lines G1, G7 to be a voltage that is higher than the applied voltage V4 to the pixel electrodes connected to the gate signal lines G2, G4, G6, G8, and additionally determines the applied voltage V1 to the pixel electrodes connected to the gate signal lines G3, G5 to be higher in comparison to the applied voltage V3. In other words, the determination portion 22 determines V1>V3>V4. Consequently, the brightness of the pixels of the pixel electrodes connected to the gate signal lines G1 to G8 may be made to be approximately the same level. In the case shown in FIG. 23, the pixel electrodes connected to the gate signal lines G3, G5 correspond to an example of the first pixel electrode, and the pixel electrodes connected to the gate signal lines G1, G7 correspond to an example of the second pixel electrode.

Figure 24A:
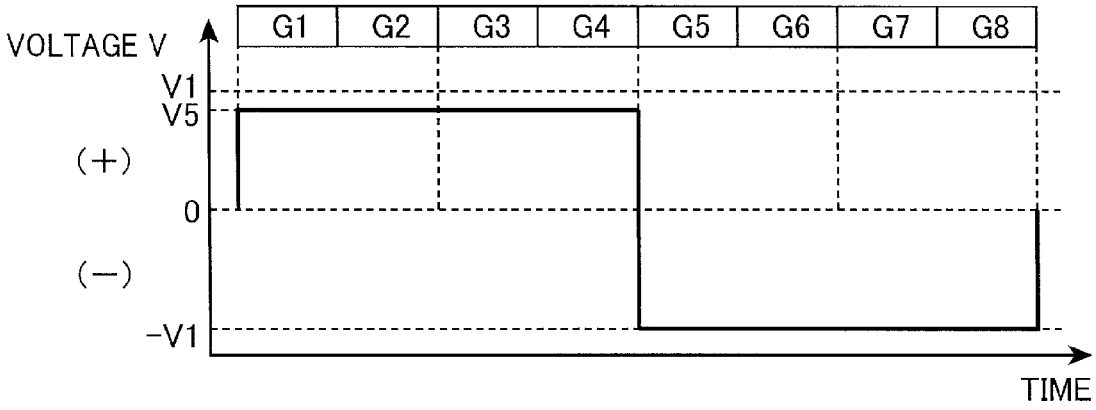
Figure 24B:
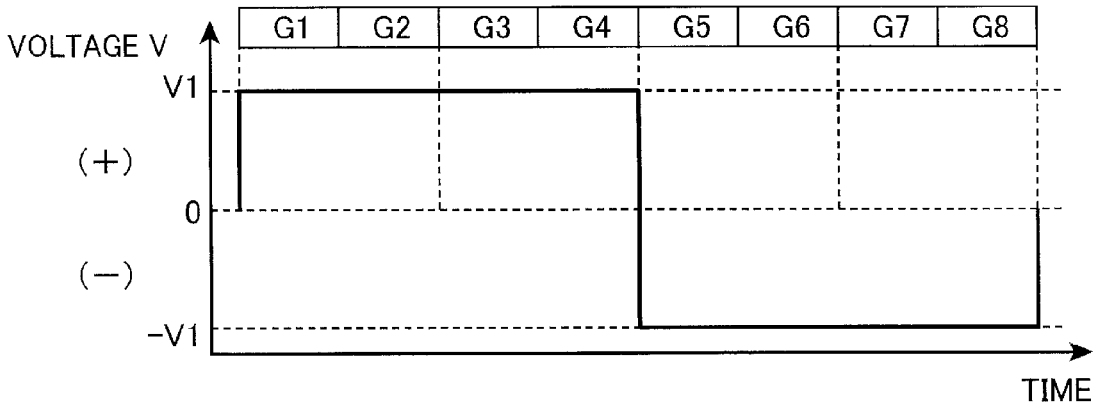

FIGS. 24A and 24B are diagrams showing the applied voltage to the source signal line when a white image is to be displayed on the pixels of the pixel electrodes connected to the source signal line S1 in a case where the drive mode is switched from the column inversion drive mode to the intermediate inversion drive mode. FIG. 24A shows the voltage level in this embodiment. FIG. 24B shows, as a comparative example, the voltage level corresponding to the signal level of the input image signal. With reference to FIG. 3, FIG. 5, and FIGS. 24A and 24B, a description is made regarding the voltage level that is determined by the determination portion 22, in a case where the inversion pattern shown in FIG. 5 is used, as the intermediate inversion drive mode, in a frame (hereinafter referred to as the "second frame" in the description with reference to FIG. 3, FIG. 5, and FIGS. 24A and 24B) which is subsequent to a frame (hereinafter referred to as the "first frame" in the description with reference to FIG. 3, FIG. 5, and FIGS. 24A and 24B) in which the column inversion drive mode shown in FIG. 3 is used.

In the first frame, the polarity of the applied voltage to the pixel electrodes connected to the source signal line S1 may all be "+" as shown in FIG. 3 in order of the gate signal lines G1 to G8. Meanwhile, in the subsequent second frame, as shown in FIG. 5, the polarity of the applied voltage to the pixel electrodes connected to the source signal line S1 may be "+, +, +, +, −, −, −, −" in order of the gate signal lines G1 to G8.

Accordingly, among the pixel electrodes connected to the source signal line S1, the polarity of the applied voltage to the pixel electrodes connected to the gate signal lines G1 to G4 in the second frame (FIG. 5) may be the same polarity as the immediately preceding first frame (FIG. 3). Meanwhile, the polarity of the applied voltage to the pixel electrodes connected to the gate signal lines G5 to G8 in the second frame (FIG. 5) may be inverted from the polarity in the immediately preceding first frame (FIG. 3).

Relative to the polarity of the applied voltage in the first frame, with the pixel electrodes in which the polarity of the applied voltage in the second frame is inverted, the responsiveness to the applied voltage may deteriorate in comparison with the pixel electrode in which the polarity is not inverted and is the same.

Thus, in the second frame, as shown in FIG. 24B, if the same voltage V1 corresponding to the signal level of the input image signal is each applied, the brightness of the pixels of the pixel electrodes connected to the gate signal lines G5 to G8 may decrease, in comparison to the pixels of the pixel electrodes connected to the gate signal lines G1 to G4.

Therefore, when the input image signal prescribes the same voltage level (white image in FIGS. 24A and 24B) for the pixel electrodes connected to the gate signal lines G1 to G8 in the second frame, the determination portion 22, as shown in FIG. 24A, determines the applied voltage V5 to the pixel electrodes connected to the gate signal lines G1 to G4 to be a voltage that is lower than the applied voltage V1 to the pixel electrodes connected to the gate signal lines G5 to G8. In other words, the determination portion 22 determines V1>V5. Consequently, the brightness of the pixels of the pixel electrodes connected to the gate signal lines G1 to G8 may be made to be approximately the same level. In the case shown in FIGS. 24A and 24B, the pixel electrodes connected to the gate signal lines G1 to G4 correspond to an example of the equivalent electrode, the pixel electrodes connected to the gate signal lines G5 to G8 correspond to an example of the inverted electrode, and the determination portion 22 corresponds to an example of the voltage determination portion.

Figure 25A:
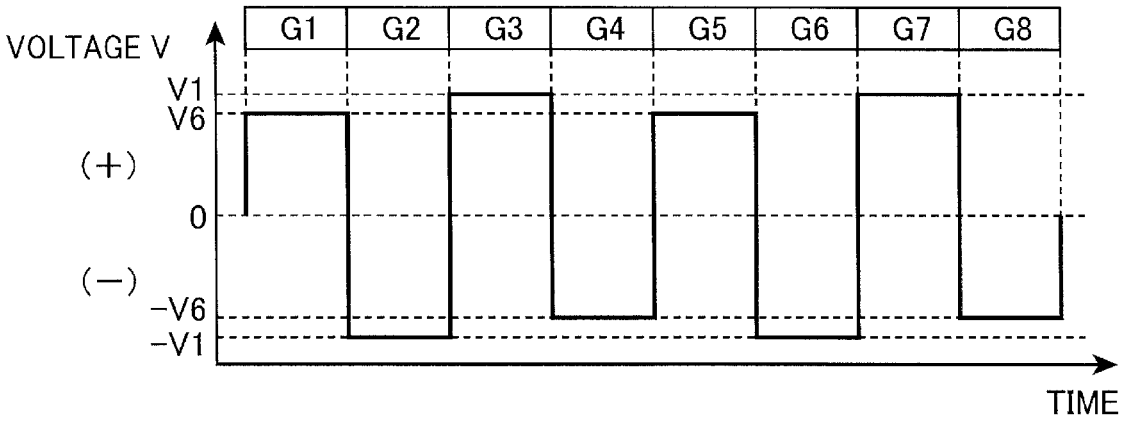
Figure 25B:
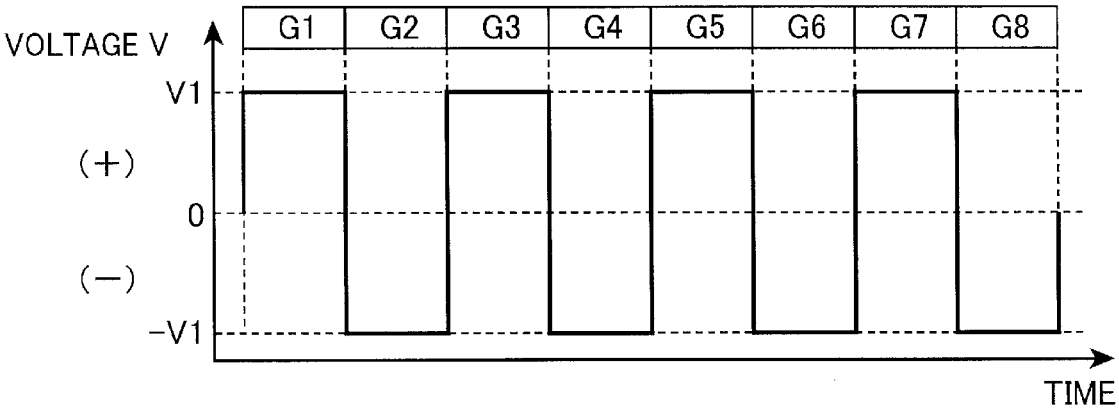

FIGS. 25A and 25B are diagrams showing the applied voltage to the source signal line when a white image is to be displayed on the pixels of the pixel electrodes connected to the source signal line S1 in a case where the drive mode is switched from the intermediate inversion drive mode to the dot inversion drive mode. FIG. 25A shows the voltage level in this embodiment. FIG. 25B shows, as a comparative example, the voltage level corresponding to the signal level of the input image signal. With reference to FIG. 4, FIG. 6, and FIGS. 25A and 25B, a description is made regarding the voltage level that is determined by the determination portion 22 when the drive mode is switched to the dot inversion drive mode shown in FIG. 4 in a frame (hereinafter referred to as the "second frame" in the description with reference to FIG. 4, FIG. 6, and FIGS. 25A and 25B) which is subsequent to a frame (hereinafter referred to as the "first frame" in the description with reference to FIG. 4, FIG. 6, and FIGS. 25A and 25B) in which the inversion pattern shown in FIG. 6 is used as the intermediate inversion drive mode.

In the first frame, the polarity of the applied voltage to the pixel electrodes connected to the source signal line S1 may be, as shown in FIG. 6, "+, +, −, −, +, +, −, −" in order of the gate signal lines G1 to G8. Meanwhile, in the subsequent second frame, as shown in FIG. 4, the polarity of the applied voltage to the pixel electrodes connected to the source signal line S1 may be "+, −, +, −, +, −, +, −" in order of the gate signal lines G1 to G8.

Accordingly, among the pixel electrodes connected to the source signal line S1, the polarity of the applied voltage to the pixel electrodes connected to the gate signal lines G1, G4, G5, G8 in the second frame (FIG. 4) may be the same polarity in the immediately preceding first frame (FIG. 6). Meanwhile, the polarity of the applied voltage to the pixel electrodes connected to the gate signal lines G2, G3, G6, G7 in the second frame (FIG. 4) may be inverted from the polarity in the immediately preceding first frame (FIG. 6).

Relative to the polarity of the applied voltage in the first frame, with the pixel electrodes in which the polarity of the applied voltage in the second frame is inverted, the responsiveness to the applied voltage may deteriorate, in comparison with the pixel electrode in which the polarity is not inverted and is the same.

Thus, in the second frame, as shown in FIG. 25B, if the same voltage V1 corresponding to the signal level of the input image signal is each applied, in comparison to the pixels of the pixel electrodes connected to the gate signal lines G1, G4, G5, G8, the brightness of the pixels of the pixel electrodes connected to the gate signal lines G2, G3, G6, G7 may decrease.

Therefore, when the input image signal prescribes the same voltage level (white image in FIGS. 25A and 25B) for the pixel electrodes connected to the gate signal lines G1 to G8 in the second frame, the determination portion 22, as shown in FIG. 25A, determines the applied voltage V6 to the pixel electrodes connected to the gate signal lines G1, G4, G5, G8 to be a voltage that is lower than the applied voltage V1 to the pixel electrodes connected to the gate signal lines G2, G3, G6, G7. In other words, the determination portion 22 determines V1>V6. Consequently, the brightness of the pixels of the pixel electrodes connected to the gate signal lines G1 to G8 may be made to be approximately the same level. In the case shown in FIGS. 25A and 25B, the pixel electrodes connected to the gate signal lines G1, G4, G5, G8 correspond to an example of the equivalent electrode, the pixel electrodes connected to the gate signal lines G2, G3, G6, G7 correspond to an example of the inverted electrode, and the determination portion 22 corresponds to an example of the voltage determination portion.

As described above, in this embodiment, the controller 11*a* switches the drive mode of the voltage application to the pixel electrodes between the column inversion drive mode and the dot inversion drive mode via the intermediate inversion drive mode. The intermediate inversion drive mode is a drive mode of inverting polarity of a voltage applied to the pixel electrodes connected to one source signal line every plural gate signal lines, inverting polarity of a voltage applied to the pixel electrodes connected to mutually adjacent source signal lines and connected to the same gate signal line, and inverting polarity of a voltage applied to the respective pixel electrodes for each frame. In other words, in the intermediate inversion drive mode, the polar state of the applied voltage is an intermediate polar state between the column inversion drive mode and the dot inversion drive mode.

Accordingly, in comparison to cases of directly switching from the column inversion drive mode to the dot inversion drive mode, or directly switching from the dot inversion drive mode to the column inversion drive mode, the drive mode may be switched smoothly. Thus, according to this embodiment, it is possible to inhibit the deterioration in the image quality, due to the generation of a boundary as a result of images displayed on the liquid crystal display panel 12 not being consecutive, during the switching of the drive mode.

In this embodiment, upon switching the drive mode (that is, upon switching between the column inversion drive mode and the intermediate inversion drive mode, and upon switching between the dot inversion drive mode and the intermediate inversion drive mode), when the signal level of the input image signal is the same, the determination portion 22 determines that the level of the applied voltage to the pixel electrodes, in which the polarity of the applied voltage between two consecutive frames is the same, to be a level that is lower than the level of the applied voltage to the pixel electrodes, in which the polarity of the applied voltage between two consecutive frames is inverted. Further, upon the switching of the inversion pattern in the intermediate inversion drive mode, when the signal level of the input image signal is the same, the determination portion 22 similarly determines that the level of the applied voltage to the pixel electrodes, in which the polarity of the applied voltage between two consecutive frames is the same, to be a level that is lower than the level of the applied voltage to the pixel electrodes, in which the polarity of the applied voltage between two consecutive frames is inverted. In comparison to cases where the polarity of the applied voltage between two consecutive frames is the same, the responsiveness to the applied voltage is deteriorated in cases where the polarity is inverted. But in this embodiment, when the signal level of the input image signal is the same, the brightness of the respective pixels may be made to be approximately the same level.

Note that the switching operation of the drive mode in the second embodiment is the same as the operation in the first embodiment described with reference to FIG. 11 to FIG. 15B. Moreover, the switching operation of the drive mode in the second embodiment may be the different operation in the first embodiment described with reference to FIG. 16 to FIG. 20.

(Others)

In the foregoing second embodiment, as shown in FIG. 11 for example, in the frame F7 which is subsequent to the frame F6 in which the frame rate is 60 Hz, the frame rate is 30 Hz. However, an embodiment in which the frame rate gradually decreases may also be adopted. For example, an embodiment, which decreases the frame rate in stages with the frame F7 being 50 Hz, the frame F8 being 40 Hz, and the frame F9 being 30 Hz, may be adopted. In this kind of embodiment also, the detector 21 detects that the frame rate in the frame F7 is less than 60 Hz. Accordingly, the controller 11*a* switches the drive mode from the column inversion drive mode to the intermediate inversion drive mode. Consequently, the same operation as the foregoing second embodiment is performed.

In the foregoing second embodiment, a case where the number of gate signal lines is n=8 has been described for simplifying the description. Nevertheless, n=8 is merely an example, and, for instance, this may be another value such as n=1024.

In the intermediate inversion drive mode shown in FIG. 5 of the foregoing first embodiment, an inversion pattern in which the polarity of the applied voltage to the pixel electrodes connected to one source signal line is inverted once is used. Moreover, in the intermediate inversion drive mode shown in FIG. 6 of the foregoing first embodiment, an inversion pattern in which the polarity of the applied voltage to the pixel electrodes connected to one source signal line is inverted twice is used. Nevertheless, in the second embodiment, the polarity inversion pattern may be an inversion pattern that is different from FIG. 5 and FIG. 6.

In substitute for the inversion pattern of FIG. 5, an inversion pattern (first polarity inversion pattern) of inverting the polarity of the applied voltage to the pixel electrodes connected to one source signal line M times (M is a positive integer) may be used. In substitute for the inversion pattern of FIG. 6, an inversion pattern (second polarity inversion pattern) of inverting the polarity of the applied voltage to the pixel electrodes connected to one source signal line N times (N is an integer that is greater than M) may be used. In substitute for the inversion pattern of FIG. 5, an inversion pattern (first polarity inversion pattern) of inverting the polarity of the applied voltage to the pixel electrodes connected to one of the source signal lines every L gate signal lines (L is an integer that is greater than 2) may be used. In substitute for the inversion pattern of FIG. 6, an inversion pattern (second polarity inversion pattern) of inverting the polarity of the applied voltage to the pixel electrodes connected to one of the source signal lines every K gate signal lines (K is an integer that is not less than 2 and less than L) may be used. Instead of using an inversion pattern of inverting the polarity every fixed number of gate signal lines such as K or L gate signal lines, an inversion pattern of inverting the polarity every different number of gate signal lines may be used.

In the foregoing second embodiment, upon switching from the column inversion drive mode to the dot inversion drive mode, the controller 11*a* sequentially uses the inversion pattern of decreasing the number of gate signal lines, in which the polarity is to be inverted, ½ at a time in the intermediate inversion drive mode. In other words, if the number n of gate signal lines is, for example, n=1024, the controller 11*a* sequentially uses, in the intermediate inversion drive mode, an inversion pattern of inverting the polarity every 512, 256, 128, 64, 32, 16, 8, 4, and 2 gate signal lines. Nevertheless, without limitation to ½ at a time, upon switching from the column inversion drive mode to the dot inversion drive mode, the controller 11*a* may sequentially use, in the intermediate inversion drive mode, an inversion pattern of gradually decreasing, in a stepwise manner, the number of gate signal lines in which the polarity is to be inverted. Upon switching from the dot inversion drive mode to the column inversion drive mode, the controller 11*a* may similarly use an inversion pattern of gradually increasing, in a stepwise manner, the number of gate signal lines in which the polarity is to be inverted.

In the foregoing second embodiment, upon switching the drive mode between the column inversion drive mode and the dot inversion drive mode, the switching is performed via the intermediate inversion drive mode. Nevertheless, the switching of the drive mode is not limited to be between the column inversion drive mode and the dot inversion drive mode.

As a modified embodiment of the foregoing second embodiment, for example, an embodiment of switching the drive mode between the column inversion drive mode (FIG. 12) and the two-line inversion drive mode (FIG. 14) of inverting the polarity every two lines may also be adopted. In this case, the switching may be performed via the intermediate inversion drive mode shown in FIG. 13, for example. Consequently, in comparison to the direct switching between the drive mode shown in FIG. 12 and the drive mode shown in FIG. 14, the drive mode may be switched smoothly. In this modified embodiment, the column inversion drive mode (FIG. 12) corresponds to an example of the first drive mode, and the two-line inversion drive mode (FIG. 14) corresponds to an example of the second drive mode.

Note that, in this modified embodiment, the first drive mode is not limited to the column inversion drive mode (FIG. 12). The first drive mode may also be, for example, a drive mode of inverting the polarity of the applied voltage to the pixel electrodes connected to one of the source signal lines every X gate signal lines (X is an integer that is greater than L). Moreover, in this modified embodiment, the second drive mode is not limited to the two-line inversion drive mode (FIG. 14). The second drive mode may also be, for example, a drive mode of inverting the polarity of the applied voltage to the pixel electrodes connected to one of the source signal lines every Y gate signal lines (Y is an integer that is not less than 1 and less than K). Here, L and K are the integers described above.

In addition, in this modified embodiment, the first drive mode may also be, for example, a drive mode of inverting the polarity of the voltage applied to the pixel electrodes connected to one source signal line I times (I is an integer that is not less than 0 and less than M), and the second drive mode may also be a drive mode of inverting the polarity of the voltage applied to the pixel electrodes connected to one source signal line J times (J is an integer that is greater than M). In this case, in the second polarity inversion pattern, the polarity of the voltage applied to the pixel electrodes connected to one source signal line may be inverted N times (N is an integer that is greater than M and less than J). Here, M and N are the integers described above.

As a different modified embodiment of the foregoing second embodiment, for example, an embodiment of switching the drive mode between the four-line inversion drive mode (FIG. 13) of inverting the polarity every four lines and the dot inversion drive mode (FIG. 15) may also be adopted. In this case, the switching may be performed via the intermediate inversion drive mode shown in FIG. 14, for example. Consequently, in comparison to the direct switching between the drive mode shown in FIG. 13 and the drive mode shown in FIG. 15, the drive mode may be switched smoothly. In this different modified embodiment, the four-line inversion drive mode shown in FIG. 13 corresponds to an example of the first drive mode, and the dot inversion drive mode shown in FIG. 15 corresponds to an example of the second drive mode.

Note that, in this different modified embodiment, the first drive mode is not limited to the four-line inversion drive mode (FIG. 13). The first drive mode may also be, for example, a drive mode of inverting the polarity of the applied voltage to the pixel electrodes connected to one of the source signal lines every X gate signal lines (X is an integer that is greater than L). Moreover, in this different modified embodiment, the second drive mode is not limited to the dot inversion drive mode (FIG. 15). The second drive mode may also be, for example, a drive mode of inverting the polarity of the applied voltage to the pixel electrodes connected to one of the source signal lines every Y gate signal lines (Y is an integer that is not less than 1 and less than K). Here, L and K are the integers described above.

In addition, in this different modified embodiment, the first drive mode may also be, for example, a drive mode of inverting the polarity of the voltage applied to the pixel electrodes connected to one source signal line I times (I is an integer that is not less than 0 and less than M), and the second drive mode may also be a drive mode of inverting the polarity of the voltage applied to the pixel electrodes connected to one source signal line J times (J is an integer that is greater than M). In this case, in the second polarity inversion pattern, the polarity of the voltage applied to the pixel electrodes connected to one source signal line may be inverted N times (N is an integer that is greater than M and less than J). Here, M and N are the integers described above.

Note that the specific embodiments described above mainly include the illustrative embodiments having the following configuration.

In one general aspect, the instant application describes a liquid crystal display portion including source signal lines, gate signal lines and pixel electrodes connected to the source signal lines and the gate signal lines, the liquid crystal display portion configured to display an image in correspondence to an input image signal for each frame; a source driver configured to apply voltages in correspondence to the input image signal to the pixel electrodes through the source signal lines; a gate driver configured to output gate signals to the gate signal lines sequentially; and a controller configured to control the source driver and the gate driver to cause the source driver to apply a voltage to each of the pixel electrodes, for each gate signal line, in response to an output of each of the gate signals from the gate driver, the pixel electrodes connected to one of the source signal lines, wherein the controller switches a drive mode of voltage application to the pixel electrodes between a first drive mode and a second drive mode, the controller causing an intermediate inversion drive mode to intervene between the first drive mode and the second drive mode, the controller in the intermediate inversion drive mode causes the source driver to alternate polarities of the voltages applied to the pixel electrodes connected to one of the source signal lines per plural gate signal lines, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame, an inverted electrode is a pixel electrode which is subjected to a different voltage in polarity from a voltage that another pixel electrode receives immediately before the inverted electrode, an equivalent electrode is a pixel electrode which is subjected to a common voltage in polarity with a voltage that another pixel electrode receives immediately before the equivalent electrode, and when the source driver, in the intermediate inversion drive mode, applies the voltages sequentially to the pixel electrodes connected to one of the source signal lines, the controller sets a longer voltage application period for the inverted electrode than for the equivalent electrode.

According to the foregoing configuration, the liquid crystal display portion includes source signal lines, gate signal lines, and pixel electrodes connected to the source signal lines and the gate signal lines. The liquid crystal display portion displays an image in correspondence to an input image signal for each frame. The source driver applies voltages in correspondence to the input image signal to the pixel electrodes through the source signal lines. The gate driver outputs gate signals to the gate signal lines sequentially. The controller controls the source driver and the gate driver to cause the source driver to apply a voltage to each of the pixel electrodes, for each gate signal line, in response to an output of each of the gate signals from the gate driver. The pixel electrodes are connected to one of the source signal lines. The controller switches a drive mode of voltage application to the pixel electrodes between a first drive mode and a second drive mode. The controller causes an intermediate inversion drive mode to intervene between the first drive mode and the second drive mode. The controller in the intermediate inversion drive mode causes the source driver to alternate polarities of the voltages applied to the pixel electrodes connected to one of the source signal lines per plural gate signal lines, and to apply the voltages so that a pair of the pixel electrodes, which are connected to one of the gate signal lines and to source signal lines adjacent to each other, are subjected to different voltage application in polarity from each other. The source driver alternates polarities of the voltages applied to the respective pixel electrodes for each frame. The inverted electrode is a pixel electrode which is subjected to a different voltage in polarity from a voltage that another pixel electrode receives immediately before the inverted electrode. The equivalent electrode is a pixel electrode which is subjected to a common voltage in polarity with a voltage that another pixel electrode receives immediately before the equivalent electrode. When the source driver, in the intermediate inversion drive mode, applies the voltages sequentially to the pixel electrodes connected to one of the source signal lines, the controller sets a longer voltage application period for the inverted electrode than for the equivalent electrode.

Here, since the responsiveness may deteriorate in the inverted electrode in comparison to the equivalent electrode, even when a voltage of the same level is applied, the actually applied voltage tends to become insufficient in the inverted electrode. Consequently, the display quality of the image may deteriorate. However, according to the foregoing configuration, the controller causes the voltage application period to the inverted electrode to be longer in comparison to the voltage application period to the equivalent electrode. Thus, it is possible to inhibit the actually applied voltage from becoming insufficient and to inhibit the excessive deterioration in the display quantity of the image.

The above general aspect may include one or more of the following features. The liquid crystal display may include the controller controls the gate driver to set a time from a point when a gate signal is output to a gate signal line connected to the equivalent electrode to a point when a gate signal is output to a subsequent gate signal line to be a reference time determined in advance, and to set a time from a point when a gate signal is output to a gate signal line connected to the inverted electrode to a point when a gate signal is output to a subsequent gate signal line to be a time longer than the reference time.

According to the foregoing configuration, the controller controls the gate driver to set a time from a point when a gate signal is output to a gate signal line connected to the equivalent electrode to a point when a gate signal is output to a subsequent gate signal line to be a reference time determined in advance, and to set a time from a point when a gate signal is output to a gate signal line connected to the inverted electrode to a point when a gate signal is output to a subsequent gate signal line to be a time longer than the reference time. Accordingly, the voltage application period to the inverted electrode may be longer than the reference time, which is the voltage application period to the equivalent electrode. Thus, it is possible to inhibit the voltage that is actually applied to the inverted electrode from becoming insufficient.

The controller in the intermediate inversion drive mode may use a first polarity inversion pattern in which there are M polarity inversions of voltages applied to the pixel electrodes connected to the one of the source signal lines, and a second polarity inversion pattern, in which there are N polarity inversions of voltages applied to the pixel electrodes connected to the one of the source signal lines, where M is a positive integer and N is an integer greater than M, wherein the controller in the intermediate inversion drive mode uses the second polarity inversion pattern after the first polarity inversion pattern to switch the first drive mode into the second drive mode, wherein the controller in the first drive mode causes the source driver to perform I polarity inversions of voltages applied to the pixel electrodes connected to the one of the source signal lines, where I is an integer not less than 0 and less than M, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame, and wherein the controller in the second drive mode causes the source driver to perform J polarity inversions of voltages applied to the pixel electrodes connected to the one of the source signal lines, where J is an integer greater than N, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame.

According to the foregoing configuration, the controller in the intermediate inversion drive mode uses a first polarity inversion pattern in which there are M polarity inversions of voltages applied to the pixel electrodes connected to the one of the source signal lines, and a second polarity inversion pattern, in which there are N polarity inversions of voltages applied to the pixel electrodes connected to the one of the source signal lines, where M is a positive integer and N is an integer greater than M. The controller in the intermediate inversion drive mode uses the second polarity inversion pattern after the first polarity inversion pattern to switch the first drive mode into the second drive mode. The controller in the first drive mode causes the source driver to perform I polarity inversions of voltages applied to the pixel electrodes connected to the one of the source signal lines, where I is an integer not less than 0 and less than M, and to apply the voltages so that a pair of the pixel electrodes, which are connected to one of the gate signal lines and to source signal lines adjacent to each other, are subjected to different voltage application in polarity from each other. The source driver alternating polarities of the voltages applied to the respective pixel electrodes for each frame. The controller in the second drive mode causes the source driver to perform J polarity inversions of voltages applied to the pixel electrodes connected to the one of the source signal lines, where J is an integer greater than N, and to apply the voltages so that a pair of the pixel electrodes, which are connected to one of the gate signal lines and to source signal lines adjacent to each other, are subjected to different voltage application in polarity from each other. The source driver alternating polarities of the voltages applied to the respective pixel electrodes for each frame. Accordingly, when the first drive mode is switched to the second drive mode via the first polarity inversion pattern and the second polarity inversion pattern, since the number of times that the polarity is inverted may gradually decrease, the drive mode may be smoothly switched from the first drive mode to the second drive mode.

The controller in the intermediate inversion drive mode may use a first polarity inversion pattern, in which there are polarity inversions of voltages applied to the pixel electrodes connected to the one of the source signal lines every L gate signal lines, and a second polarity inversion pattern, in which there are polarity inversions of voltages applied to the pixel electrodes connected to the one of the source signal lines every K gate signal lines, where L is an integer greater than 2 and K is an integer not less than 2 and less than L, wherein the controller in the intermediate inversion drive mode uses the second polarity inversion pattern after the first polarity inversion pattern to switch the first drive mode into the second drive mode, wherein the controller in the first drive mode causes the source driver to perform polarity inversions of voltages applied to the pixel electrodes connected to the one of the source signal lines every X gate signal lines, where X is an integer greater than L, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame, and wherein the controller in the second drive mode causes the source driver to perform polarity inversions of voltages applied to the pixel electrodes connected to the one of the source signal lines every Y gate signal line, where Y is an integer not less than 1 and less than K, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame.

According to the foregoing configuration, the controller in the intermediate inversion drive mode uses a first polarity inversion pattern, in which there are polarity inversions of voltages applied to the pixel electrodes connected to the one of the source signal lines every L gate signal lines, and a second polarity inversion pattern, in which there are polarity inversions of voltages applied to the pixel electrodes connected to the one of the source signal lines every K gate signal lines, where L is an integer greater than 2 and K is an integer not less than 2 and less than L. The controller in the intermediate inversion drive mode uses the second polarity inversion pattern after the first polarity inversion pattern to switch the first drive mode into the second drive mode. The controller in the first drive mode causes the source driver to perform polarity inversions of voltages applied to the pixel electrodes connected to the one of the source signal lines every X gate signal lines, where X is an integer greater than L, and to apply the voltages so that a pair of the pixel electrodes, which are connected to one of the gate signal lines and to source signal lines adjacent to each other, are subjected to different voltage application in polarity from each other. The source driver alternates polarities of the voltages applied to the respective pixel electrodes for each frame. The controller in the second drive mode causes the source driver to perform polarity inversions of voltages applied to the pixel electrodes connected to the one of the source signal lines every Y gate signal line, where Y is an integer not less than 1 and less than K, and to apply the voltages so that a pair of the pixel electrodes, which are connected to one of the gate signal lines and to source signal lines adjacent to each other, are subjected to different voltage application in polarity from each other. The source driver alternating polarities of the voltages applied to the respective pixel electrodes for each frame. Accordingly, when the first drive mode is switched to the second drive mode via the first polarity inversion pattern and the second polarity inversion pattern, since the number of plural gate signal lines upon inverting the polarity every plural gate signal lines may gradually decrease, the first drive mode may be switched smoothly to the second drive mode.

The controller, in the intermediate inversion drive mode, may use the first polarity inversion pattern at least for two consecutive frames, and uses the second polarity inversion pattern at least for two consecutive frames.

According to the foregoing configuration, the controller, in the intermediate inversion drive mode, uses the first polarity inversion pattern at least for two consecutive frames, and uses the second polarity inversion pattern at least for two consecutive frames. Upon switching from the first drive mode to the second drive mode, when the first polarity inversion pattern is used in the subsequent frame of the first drive mode and the second polarity inversion pattern is used in the subsequent frame after that, voltages of the same polarity may be applied to the pixel electrodes for three consecutive frames and, therefore, there is a possibility that the control may become complicated. However, according to the foregoing configuration, upon switching from the first drive mode to the second drive mode, when the first polarity inversion pattern is used in the subsequent frame of the first drive mode, the first polarity inversion pattern is used in the subsequent frame after that. Further, when the second polarity inversion pattern is used in the frame that is subsequent to the frame in which the first polarity inversion pattern is used, the second polarity inversion pattern is used in the subsequent frame after that. Accordingly, it is possible to prevent voltages of the same polarity from being applied to the pixel electrodes for three consecutive frames.

The liquid crystal display portion may display the image in order of a first frame and a second frame, when the first polarity inversion pattern is used in the first frame and the second polarity inversion pattern is used in the second frame, the inverted electrode in the second frame includes a first pixel electrode, which is subjected to a different voltage in polarity from the first frame, and a second pixel electrode, which is subjected to a common voltage in polarity with the first frame, and the controller sets a voltage application period to the first pixel electrode to be longer than a voltage application period to the second pixel electrode.

According to the foregoing configuration, the liquid crystal display portion displays the image in order of a first frame and a second frame. When the first polarity inversion pattern is used in the first frame and the second polarity inversion pattern is used in the second frame, the inverted electrode in the second frame includes a first pixel electrode, which is subjected to a different voltage in polarity from the first frame, and a second pixel electrode, which is subjected to a common voltage in polarity with the first frame. The controller sets a voltage application period to the first pixel electrode to be longer than a voltage application period to the second pixel electrode.

Here, since the polarity has been inverted from the first frame, even when a voltage of the same level is applied, the voltage that is actually applied to the pixel electrodes in the first pixel electrode may decrease in the amount that the polarity is inverted in comparison to the second pixel electrode having the same polarity as the first frame. However, with the foregoing configuration, the voltage application period to the first pixel electrode is set to be longer in comparison to the voltage application period to the second pixel electrode. Accordingly, it is possible to inhibit the voltage that is actually applied in the first pixel electrode from becoming insufficient.

In the foregoing liquid crystal display device, the controller may apply, more than once, a voltage corresponding to the input image signal to the first pixel electrode.

According to the foregoing configuration, the controller applies, more than once, a voltage corresponding to the input image signal to the first pixel electrode. In this way, since the voltage is applied more than once, it is possible to inhibit the voltage that is actually applied in the first pixel electrode from becoming insufficient.

In another general aspect, the instant application describes a liquid crystal display that may include a liquid crystal display portion including source signal lines, gate signal lines and pixel electrodes connected to the source signal lines and the gate signal lines, the liquid crystal display portion configured to display an image in correspondence to an input image signal for each frame; a driver configured to apply voltages to the pixel electrodes in correspondence to the input image signal; and a controller configured to control the driver to switch a drive mode of voltage application to the pixel electrodes between a first drive mode and a second drive mode, the controller causing an intermediate inversion drive mode to intervene between the first drive mode and the second drive mode, wherein the controller in the intermediate inversion drive mode causes the driver to alternate polarities of the voltages applied to the pixel electrodes connected to one of the source signal lines per plural gate signal lines, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame.

According to the foregoing configuration, the liquid crystal display portion includes source signal lines, gate signal lines and pixel electrodes connected to the source signal lines and the gate signal lines. The liquid crystal display portion displays an image in correspondence to an input image signal for each frame. The driver applies voltages to the pixel electrodes in correspondence to the input image signal. The controller controls the driver to switch a drive mode of voltage application to the pixel electrodes between a first drive mode and a second drive mode. The controller causes an intermediate inversion drive mode to intervene between the first drive mode and the second drive mode. The controller in the intermediate inversion drive mode causes the driver to alternate polarities of the voltages applied to the pixel electrodes connected to one of the source signal lines per plural gate signal lines, and to apply the voltages so that a pair of the pixel electrodes, which are connected to one of the gate signal lines and to source signal lines adjacent to each other, are subjected to different voltage application in polarity from each other. The driver alternates polarities of the voltages applied to the respective pixel electrodes for each frame.

Accordingly, the drive mode may be smoothly switched in comparison to cases of directly switching from the first drive mode to the second drive mode or directly switching from the second drive mode to the first drive mode. Thus, it is possible to inhibit the deterioration in the image quality, due to the generation of a boundary between images as a result of discontinuous image display on the liquid crystal display portion, during the switching of the drive mode.

The controller in the intermediate inversion drive mode may use a first polarity inversion pattern, in which there are M polarity inversions of voltages applied to the pixel electrodes connected to the one of the source signal lines, where M is a positive integer, wherein the controller in the first drive mode causes the driver to perform I polarity inversions of voltages applied to the pixel electrodes connected to the one of the source signal lines, where I is an integer not less than 0 and less than M, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame, and wherein the controller in the second drive mode causes the driver to perform J polarity inversions of voltages applied to the pixel electrodes connected to the one of the source signal lines, where J is an integer greater than N, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame.

According to the foregoing configuration, the controller in the intermediate inversion drive mode uses a first polarity inversion pattern, in which there are M polarity inversions of voltages applied to the pixel electrodes connected to the one of the source signal lines, where M is a positive integer. The controller in the first drive mode causes the driver to perform I polarity inversions of voltages applied to the pixel electrodes connected to the one of the source signal lines, where I is an integer not less than 0 and less than M, and to apply the voltages so that a pair of the pixel electrodes, which are connected to one of the gate signal lines and to source signal lines adjacent to each other, are subjected to different voltage application in polarity from each other. The driver alternates polarities of the voltages applied to the respective pixel electrodes for each frame. The controller in the second drive mode causes the driver to perform J polarity inversions of voltages applied to the pixel electrodes connected to the one of the source signal lines, where J is an integer greater than N, and to apply the voltages so that a pair of the pixel electrodes, which are connected to one of the gate signal lines and to source signal lines adjacent to each other, are subjected to different voltage application in polarity from each other. The driver alternates polarities of the voltages applied to the respective pixel electrodes for each frame. Accordingly, when the first drive mode is switched to the second drive mode via the first polarity inversion pattern, since the number of times that the polarity is inverted may gradually decrease, the drive mode may be smoothly switched from the first drive mode to the second drive mode.

The controller in the intermediate inversion drive mode may further use a second polarity inversion pattern, in which there are N polarity inversions of voltages applied to the pixel electrodes connected to the one of the source signal lines, where N is an integer greater than M and less than J, and wherein the controller in the intermediate inversion drive mode uses the second polarity inversion pattern after the first polarity inversion pattern to switch the first drive mode into the second drive mode.

According to the foregoing configuration, the controller in the intermediate inversion drive mode further uses a second polarity inversion pattern, in which there are N polarity inversions of voltages applied to the pixel electrodes connected to the one of the source signal lines, where N is an integer greater than M and less than J. The controller in the intermediate inversion drive mode uses the second polarity inversion pattern after the first polarity inversion pattern to switch the first drive mode into the second drive mode. Accordingly, when the first drive mode is switched to the second drive mode via the first polarity inversion pattern and the second polarity inversion pattern, since the number of times that the polarity is inverted may gradually decrease, the drive mode may be smoothly switched from the first drive mode to the second drive mode.

The controller in the intermediate inversion drive mode may use a first polarity inversion pattern, in which there are polarity inversions of voltages applied to the pixel electrodes connected to the one of the source signal lines every L gate signal lines, and a second polarity inversion pattern, in which there are polarity inversions of voltages applied to the pixel electrodes connected to the one of the source signal lines every K gate signal lines, where L is an integer greater than 2 and K is an integer not less than 2 and less than L, wherein the controller in the intermediate inversion drive mode uses the second polarity inversion pattern after the first polarity inversion pattern to switch the first drive mode into the second drive mode, wherein the controller in the first drive mode causes the driver to perform polarity inversions of voltages applied to the pixel electrodes connected to the one of the source signal lines every X gate signal lines, where X is an integer greater than L, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame, and wherein the controller in the second drive mode causes the driver to perform polarity inversions of voltages applied to the pixel electrodes connected to the one of the source signal lines every Y gate signal line, where Y is an integer not less than 1 and less than K, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame.

According to the foregoing configuration, the controller in the intermediate inversion drive mode uses a first polarity inversion pattern, in which there are polarity inversions of voltages applied to the pixel electrodes connected to the one of the source signal lines every L gate signal lines, and a second polarity inversion pattern, in which there are polarity inversions of voltages applied to the pixel electrodes connected to the one of the source signal lines every K gate signal lines, where L is an integer greater than 2 and K is an integer not less than 2 and less than L. The controller in the intermediate inversion drive mode uses the second polarity inversion pattern after the first polarity inversion pattern to switch the first drive mode into the second drive mode. The controller in the first drive mode causes the driver to perform polarity inversions of voltages applied to the pixel electrodes connected to the one of the source signal lines every X gate signal lines, where X is an integer greater than L, and to apply the voltages so that a pair of the pixel electrodes, which are connected to one of the gate signal lines and to source signal lines adjacent to each other, are subjected to different voltage application in polarity from each other. The driver alternates polarities of the voltages applied to the respective pixel electrodes for each frame. The controller in the second drive mode causes the driver to perform polarity inversions of voltages applied to the pixel electrodes connected to the one of the source signal lines every Y gate signal line, where Y is an integer not less than 1 and less than K, and to apply the voltages so that a pair of the pixel electrodes, which are connected to one of the gate signal lines and to source signal lines adjacent to each other, are subjected to different voltage application in polarity from each other. The driver alternates polarities of the voltages applied to the respective pixel electrodes for each frame. Accordingly, when the first drive mode is switched to the second drive mode via the first polarity inversion pattern and the second polarity inversion pattern, since the number of plural gate signal lines upon inverting the polarity every plural gate signal lines may gradually decrease, the first drive mode may be switched smoothly to the second drive mode.

The controller, in the intermediate inversion drive mode, may use the first polarity inversion pattern at least for two consecutive frames, and uses the second polarity inversion pattern at least for two consecutive frames.

According to the foregoing configuration, the controller, in the intermediate inversion drive mode, uses the first polarity inversion pattern at least for two consecutive frames, and uses the second polarity inversion pattern at least for two consecutive frames. Upon switching from the first drive mode to the second drive mode, when the first polarity inversion pattern is used in the subsequent frame of the first drive mode and the second polarity inversion pattern is used in the subsequent frame after that, voltages of the same polarity may be applied to the pixel electrodes for three consecutive frames and, therefore, there is a possibility that the control may become complicated. However, according to the foregoing configuration, upon switching from the first drive mode to the second drive mode, when the first polarity inversion pattern is used in the subsequent frame of the first drive mode, the first polarity inversion pattern is used in the subsequent frame after that. Further, when the second polarity inversion pattern is used in the frame that is subsequent to the frame in which the first polarity inversion pattern is used, the second polarity inversion pattern is used in the subsequent frame after that. Accordingly, it is possible to prevent voltages of the same polarity from being applied to the pixel electrodes for three consecutive frames.

The liquid crystal display portion may display the image in order of a first frame and a second frame, in a case where the first polarity inversion pattern is used in the first frame and the second polarity inversion pattern is used in the second frame, when voltages are sequentially applied, for each gate signal line, to the pixel electrodes connected to one of the source signal lines in the second frame, the pixel electrodes include inverted electrodes, each of which is subjected to a different voltage in polarity from a voltage that another pixel electrode receives immediately before the inverted electrode, the inverted electrodes include a first pixel electrode which is subjected to a different voltage in polarity from the first frame, and a second pixel electrode which is subjected to a common voltage in polarity with the first frame, the controller is configured to include a determination portion that determines a voltage to be applied to the first pixel electrode and the second pixel electrode in response to the input image signal, and when the input image signal prescribes a same voltage level to the first pixel electrode and the second pixel electrode in the second frame, the determination portion determines that a voltage to be applied to the first pixel electrode is higher than a voltage to be applied to the second pixel electrode.

According to the foregoing configuration, the liquid crystal display portion displays the image in order of a first frame and a second frame. In a case where the first polarity inversion pattern is used in the first frame and the second polarity inversion pattern is used in the second frame, when voltages are sequentially applied, for each gate signal line, to the pixel electrodes connected to one of the source signal lines in the second frame, the pixel electrodes include inverted electrodes, each of which is subjected to a different voltage in polarity from a voltage that another pixel electrode receives immediately before the inverted electrode. The inverted electrodes include a first pixel electrode which is subjected to a different voltage in polarity from the first frame, and a second pixel electrode which is subjected to a common voltage in polarity with the first frame. The controller includes a determination portion that determines a voltage to be applied to the first pixel electrode and the second pixel electrode in response to the input image signal. When the input image signal prescribes a same voltage level to the first pixel electrode and the second pixel electrode in the second frame, the determination portion determines that a voltage to be applied to the first pixel electrode is higher than a voltage to be applied to the second pixel electrode.

Here, since the polarity has been inverted from the first frame in the first pixel electrode, even when a voltage of the same level is applied, the voltage that is actually applied to the pixel electrode in the first pixel electrode may decrease in the amount that the polarity is inverted in comparison to the second pixel electrode having the same polarity as the first frame. However, according to the foregoing configuration, when the input image signal prescribes the same voltage level to the first pixel electrode and the second pixel electrode, the voltage to be applied to the first pixel electrode is determined to be a higher voltage than the voltage to be applied to the second pixel electrode. Accordingly, it is possible to correct the decrease in the voltage that is actually applied to the first pixel electrode.

The liquid crystal display portion may display the image in order of a first frame and a second frame, the pixel electrodes connected to the one of the source signal lines include an equivalent electrode, which is, in the second frame, subjected to a common voltage in polarity with the voltage applied in the first frame, and an inverted electrode, which is, in the second frame, subjected to a different voltage in polarity from the voltage applied in the first frame, the controller is configured to include a voltage determination portion that determines a voltage to be applied to the equivalent electrode and the inverted electrode in response to the input image signal, and when the input image signal prescribes a same voltage level to the equivalent electrode and the inverted electrode in the second frame, the voltage determination portion determines that a voltage to be applied to the equivalent electrode is to be lower than a voltage to be applied to the inverted electrode.

According to the foregoing configuration, the liquid crystal display portion displays the image in order of a first frame and a second frame. The pixel electrodes connected to the one of the source signal lines include an equivalent electrode, which is, in the second frame, subjected to a common voltage in polarity with the voltage applied in the first frame, and an inverted electrode, which is, in the second frame, subjected to a different voltage in polarity from the voltage applied in the first frame. The controller includes a voltage determination portion that determines a voltage to be applied to the equivalent electrode and the inverted electrode in response to the input image signal. When the input image signal prescribes a same voltage level to the equivalent electrode and the inverted electrode in the second frame, the voltage determination portion determines that a voltage to be applied to the equivalent electrode is to be lower than a voltage to be applied to the inverted electrode.

Here, since the polarity is the same as the first frame in the equivalent electrode, even when a voltage of the same level is applied, the voltage that is actually applied to the pixel electrodes in the equivalent electrode may increase in the amount that the polarity is not inverted in comparison to the inverted electrode having polarity which is inverted from the first frame. However, according to the foregoing configuration, when the input image signal prescribes the same voltage level to the equivalent electrode and the inverted electrode, the voltage to be applied to the equivalent electrode is determined to be a higher voltage than the voltage to be applied to the inverted electrode. Accordingly, it is possible to suppress the increase in the voltage that is actually applied to the pixel electrode in the equivalent electrode.

The controller may set a frame period during the first drive mode to be shorter than a frame period during the intermediate inversion drive mode.

According to the foregoing configuration, the controller sets a frame period during the first drive mode to be shorter than a frame period during the intermediate inversion drive mode. Accordingly, it is possible to favorably control the driver in the first drive mode, in a frame period that is shorter than the frame period during the intermediate inversion drive mode.

The controller may switch the drive mode between the first drive mode and the second drive mode based on a feature amount of the input image signal.

According to the foregoing configuration, the controller switches the drive mode between the first drive mode and the second drive mode based on a feature amount of the input image signal. Accordingly, it is possible to use a drive mode that is suitable for the feature amount of the input image signal.

The feature amount may be a frame rate of image display on the liquid crystal display portion, and the controller may switch the drive mode to the first drive mode when the frame rate is equal to or greater than a reference value, and switches the drive mode to the second drive mode when the frame rate is less than the reference value.

According to the foregoing configuration, the feature amount is a frame rate of image display on the liquid crystal display portion. The controller switches the drive mode to the first drive mode when the frame rate is equal to or greater than a reference value, and switches the drive mode to the second drive mode when the frame rate is less than the reference value. Accordingly, it is possible to use a drive mode that is suitable for the frame rate.

The feature amount may be a moving amount of an object in an image displayed on the liquid crystal display portion, and the controller may switch the drive mode to the first drive mode when the moving amount is equal to or greater than a threshold value, and switches the drive mode to the second drive mode when the moving amount is less than the threshold value.

According to the foregoing configuration, the feature amount is a moving amount of an object in an image displayed on the liquid crystal display portion. The controller switches the drive mode to the first drive mode when the moving amount is equal to or greater than a threshold value, and switches the drive mode to the second drive mode when the moving amount is less than the threshold value. Accordingly, it is possible to use a drive mode that is suitable for the moving amount of the object in the image.

The controller in the first drive mode may control the source driver in accordance with a column inversion drive mode, wherein the controller in the second drive mode controls the source driver in accordance with a dot inversion drive mode, wherein the controller in the column inversion drive mode causes the source driver to apply voltages of a common polarity to the pixel electrodes connected to one of the source signal lines, and to apply the voltages so that a pair of the pixel electrodes, which are connected to source signal lines adjacent to each other, are subjected to different voltage application in polarity from each other, the source driver alternating polarities of the voltages applied to the respective pixel electrodes for each frame, and wherein the controller in the dot inversion drive mode causes the source driver to apply different voltages in polarity to mutually adjacent pixel electrodes, the source driver alternating polarities of the voltages applied to the respective pixel electrodes for each frame.

According to the foregoing configuration, the controller in the first drive mode controls the source driver in accordance with a column inversion drive mode. The controller in the second drive mode controls the source driver in accordance with a dot inversion drive mode. The controller in the column inversion drive mode causes the source driver to apply voltages of a common polarity to the pixel electrodes connected to one of the source signal lines, and to apply the voltages so that a pair of the pixel electrodes, which are connected to source signal lines adjacent to each other, are subjected to different voltage application in polarity from each other. The source driver alternates polarities of the voltages applied to the respective pixel electrodes for each frame. The controller in the dot inversion drive mode causes the source driver to apply different voltages in polarity to mutually adjacent pixel electrodes. The source driver alternates polarities of the voltages applied to the respective pixel electrodes for each frame. Accordingly, in the column inversion drive mode, since voltages of the same polarity are applied to the pixel electrodes connected to one of the source signal lines, it is possible to operate at high-speed in comparison to the dot inversion drive mode. Meanwhile, in the dot inversion drive mode, since voltages of reverse polarities are applied to mutually adjacent pixel electrodes, the polarity inversion to the pixel electrodes is performed finely in comparison to the column inversion drive mode, and hence, it is possible to improve the display quality of the image.

INDUSTRIAL APPLICABILITY

In a liquid crystal display device for displaying images based on a input image signal for each frame on a liquid crystal display portion, the present disclosure is useful as a liquid crystal display device capable of inhibiting the excessive deterioration in the display quality of the image during the switching of the drive mode of the liquid crystal display portion.

What is claimed is:

1. A liquid crystal display device, comprising:

a liquid crystal display portion including source signal lines, gate signal lines and pixel electrodes connected to the source signal lines and the gate signal lines, the liquid crystal display portion configured to display an image in correspondence to an input image signal for each frame;

a source driver configured to apply voltages in correspondence to the input image signal to the pixel electrodes through the source signal lines;

a gate driver configured to output gate signals to the gate signal lines sequentially; and a controller configured to control the source driver and the gate driver to cause the source driver to apply a voltage to each of the pixel electrodes, for each gate signal line, in response to an output of each of the gate signals from the gate driver, the pixel electrodes connected to one of the source signal lines, wherein:

the controller switches a drive mode of voltage application to the pixel electrodes between a first drive mode and a second drive mode, the controller causing an intermediate inversion drive mode to intervene between the first drive mode and the second drive mode, the controller in the intermediate inversion drive mode causes the source driver to alternate polarities of the voltages applied to the pixel electrodes connected to one of the source signal lines per plural successive adjacent gate signal lines, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame, an inverted electrode is a pixel electrode which is subjected to a different voltage in polarity from a voltage that another pixel electrode receives immediately before the inverted electrode, an equivalent electrode is a pixel electrode which is subjected to a common voltage in polarity with a voltage that another pixel electrode receives immediately before the equivalent electrode, and when the source driver, in the intermediate inversion drive mode, applies the voltages sequentially to the pixel electrodes connected to one of the source signal lines, the controller sets a longer voltage application period for the inverted electrode than for the equivalent electrode.

2. The liquid crystal display device according to claim 1, wherein the controller controls the gate driver to set a time from a point when a gate signal is output to a gate signal line connected to the equivalent electrode to a point when a gate signal is output to a subsequent gate signal line to be a reference time determined in advance, and to set a time from a point when a gate signal is output to a gate signal line connected to the inverted electrode to a point when a gate signal is output to a subsequent gate signal line to be a time longer than the reference time.

3. The liquid crystal display device according to claim 1, wherein the controller in the intermediate inversion drive mode uses a first polarity inversion pattern in which there are M polarity inversions of voltages applied to the pixel electrodes connected to the one of the source signal lines, and a second polarity inversion pattern, in which there are N polarity inversions of voltages applied to the pixel electrodes connected to the one of the source signal lines, where M is a positive integer and N is an integer greater than M, wherein the controller in the intermediate inversion drive mode uses the second polarity inversion pattern after the first polarity inversion pattern to switch the first drive mode into the second drive mode, wherein the controller in the first drive mode causes the source driver to perform I polarity inversions of voltages applied to the pixel electrodes connected to the one of the source signal lines, where I is an integer not less than 0 and less than M, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame, and wherein the controller in the second drive mode causes the source driver to perform J polarity inversions of voltages applied to the pixel electrodes connected to the one of the source signal lines, where J is an integer greater than N, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame.

4. The liquid crystal display device according to claim 3, wherein the controller, in the intermediate inversion drive mode, uses the first polarity inversion pattern at least for two consecutive frames, and uses the second polarity inversion pattern at least for two consecutive frames.

5. The liquid crystal display device according to claim 3, wherein the liquid crystal display portion displays the image in order of a first frame and a second frame, when the first polarity inversion pattern is used in the first frame and the second polarity inversion pattern is used in the second frame, the inverted electrode in the second frame includes a first pixel electrode, which is subjected to a different voltage in polarity from the first frame, and a second pixel electrode, which is subjected to a common voltage in polarity with the first frame, and the controller sets a voltage application period to the first pixel electrode to be longer than a voltage application period to the second pixel electrode.

6. The liquid crystal display device according to claim 1, wherein the controller in the intermediate inversion drive mode uses a first polarity inversion pattern, in which there are polarity inversions of voltages applied to the pixel electrodes connected to the one of the source signal lines every L gate signal lines, and a second polarity inversion pattern, in which there are polarity inversions of voltages applied to the pixel electrodes connected to the one of the source signal lines every K gate signal lines, where L is an integer greater than 2 and K is an integer not less than 2 and less than L, wherein the controller in the intermediate inversion drive mode uses the second polarity inversion pattern after the first polarity inversion pattern to switch the first drive mode into the second drive mode, wherein the controller in the first drive mode causes the source driver to perform polarity inversions of voltages applied to the pixel electrodes connected to the one of the source signal lines every X gate signal lines, where X is an integer greater than L, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame, and wherein the controller in the second drive mode causes the source driver to perform polarity inversions of voltages applied to the pixel electrodes connected to the one of the source signal lines every Y gate signal line, where Y is an integer not less than 1 and less than K, and to apply the voltages so that a pair of the pixel electrodes, which are connected to one of the gate signal lines and to source signal lines adjacent to each other, are subjected to different voltage application in polarity from each other, the source driver alternating polarities of the voltages applied to the respective pixel electrodes for each frame.

7. The liquid crystal display device according to claim 1, wherein the controller sets a frame period during the first drive mode to be shorter than a frame period during the intermediate inversion drive mode.

8. The liquid crystal display device according to claim 1, wherein the controller switches the drive mode between the first drive mode and the second drive mode based on a feature amount of the input image signal.

9. The liquid crystal display device according to claim 8, wherein the feature amount is a frame rate of image display on the liquid crystal display portion, and the controller switches the drive mode to the first drive mode when the frame rate is equal to or greater than a reference value, and switches the drive mode to the second drive mode when the frame rate is less than the reference value.

10. The liquid crystal display device according to claim 8, wherein the feature amount is a moving amount of an object in an image displayed on the liquid crystal display portion, and the controller switches the drive mode to the first drive mode when the moving amount is equal to or greater than a threshold value, and switches the drive mode to the second drive mode when the moving amount is less than the threshold value.

11. The liquid crystal display device according to claim 1, wherein the controller in the first drive mode controls the source driver in accordance with a column inversion drive mode, wherein the controller in the second drive mode controls the source driver in accordance with a dot inversion drive mode, wherein the controller in the column inversion drive mode causes the source driver to apply voltages of a common polarity to the pixel electrodes connected to one of the source signal lines, and to apply the voltages so that a pair of the pixel electrodes, which are connected to source signal lines adjacent to each other, are subjected to different voltage application in polarity from each other, the source driver alternating polarities of the voltages applied to the respective pixel electrodes for each frame, and wherein the controller in the dot inversion drive mode causes the source driver to apply different voltages in polarity to mutually adjacent pixel electrodes, the source driver alternating polarities of the voltages applied to the respective pixel electrodes for each frame.

12. The liquid crystal display device according to claim 1, wherein the first drive mode is a column inversion drive mode and the second drive mode is a dot inversion drive mode.

13. A liquid crystal display device, comprising:

a liquid crystal display portion including source signal lines, gate signal lines and pixel electrodes connected to the source signal lines and the gate signal lines, the liquid crystal display portion configured to display an image in correspondence to an input image signal for each frame;

a driver configured to apply voltages to the pixel electrodes in correspondence to the input image signal; and a controller configured to control the driver to switch a drive mode of voltage application to the pixel electrodes between a first drive mode and a second drive mode, the controller causing an intermediate inversion drive mode to intervene between the first drive mode and the second drive mode, wherein the controller in the intermediate inversion drive mode causes the driver to alternate polarities of the voltages applied to the pixel electrodes connected to one of the source signal lines per plural successive adjacent gate signal lines, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame.

14. The liquid crystal display device according to claim 13, wherein wherein the controller in the intermediate inversion drive mode uses a first polarity inversion pattern, in which there are M polarity inversions of voltages applied to the pixel electrodes connected to the one of the source signal lines, where M is a positive integer, wherein the controller in the first drive mode causes the driver to perform I polarity inversions of voltages applied to the pixel electrodes connected to the one of the source signal lines, where I is an integer not less than 0 and less than M, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame, and wherein the controller in the second drive mode causes the driver to perform J polarity inversions of voltages applied to the pixel electrodes connected to the one of the source signal lines, where J is an integer greater than N, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame.

15. The liquid crystal display device according to claim 14, wherein the controller in the intermediate inversion drive mode further uses a second polarity inversion pattern, in which there are N polarity inversions of voltages applied to the pixel electrodes connected to the one of the source signal lines, where N is an integer greater than M and less than J, and wherein the controller in the intermediate inversion drive mode uses the second polarity inversion pattern after the first polarity inversion pattern to switch the first drive mode into the second drive mode.

16. The liquid crystal display device according to claim 15, wherein the controller, in the intermediate inversion drive mode, uses the first polarity inversion pattern at least for two consecutive frames, and uses the second polarity inversion pattern at least for two consecutive frames.

17. The liquid crystal display device according to claim 13, wherein the controller in the intermediate inversion drive mode uses a first polarity inversion pattern, in which there are polarity inversions of voltages applied to the pixel electrodes connected to the one of the source signal lines every L gate signal lines, and a second polarity inversion pattern, in which there are polarity inversions of voltages applied to the pixel electrodes connected to the one of the source signal lines every K gate signal lines, where L is an integer greater than 2 and K is an integer not less than 2 and less than L, wherein the controller in the intermediate inversion drive mode uses the second polarity inversion pattern after the first polarity inversion pattern to switch the first drive mode into the second drive mode, wherein the controller in the first drive mode causes the driver to perform polarity inversions of voltages applied to the pixel electrodes connected to the one of the source signal lines every X gate signal lines, where X is an integer greater than L, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame, and wherein the controller in the second drive mode causes the driver to perform polarity inversions of voltages applied to the pixel electrodes connected to the one of the source signal lines every Y gate signal line, where Y is an integer not less than 1 and less than K, and to apply the voltages so that a pair of the pixel electrodes, which are connected to one of the gate signal lines and to source signal lines adjacent to each other, are subjected to different voltage application in polarity from each other, the driver alternating polarities of the voltages applied to the respective pixel electrodes for each frame.

18. The liquid crystal display device according to claim 17, wherein the liquid crystal display portion displays the image in order of a first frame and a second frame, in a case where the first polarity inversion pattern is used in the first frame and the second polarity inversion pattern is used in the second frame, when voltages are sequentially applied, for each gate signal line, to the pixel electrodes connected to one of the source signal lines in the second frame, the pixel electrodes include inverted electrodes, each of which is subjected to a different voltage in polarity from a voltage that another pixel electrode receives immediately before the inverted electrode, the inverted electrodes include a first pixel electrode which is subjected to a different voltage in polarity from the first frame, and a second pixel electrode which is subjected to a common voltage in polarity with the first frame, the controller is configured to include a determination portion that determines a voltage to be applied to the first pixel electrode and the second pixel electrode in response to the input image signal, and when the input image signal prescribes a same voltage level to the first pixel electrode and the second pixel electrode in the second frame, the determination portion determines that a voltage to be applied to the first pixel electrode is higher than a voltage to be applied to the second pixel electrode.

19. The liquid crystal display device according to claim 13, wherein the liquid crystal display portion displays the image in order of a first frame and a second frame, the pixel electrodes connected to the one of the source signal lines include an equivalent electrode, which is, in the second frame, subjected to a common voltage in polarity with the voltage applied in the first frame, and an inverted electrode, which is, in the second frame, subjected to a different voltage in polarity from the voltage applied in the first frame, the controller is configured to include a voltage determination portion that determines a voltage to be applied to the equivalent electrode and the inverted electrode in response to the input image signal, and when the input image signal prescribes a same voltage level to the equivalent electrode and the inverted electrode in the second frame, the voltage determination portion determines that a voltage to be applied to the equivalent electrode is to be lower than a voltage to be applied to the inverted electrode.

20. The liquid crystal display device according to claim 13, wherein the first drive mode is a column inversion drive mode and the second drive mode is a dot inversion drive mode.

* * * * *